US005614769A

United States Patent [19]

Kuroda

[11] Patent Number: 5,614,769

[45] Date of Patent: Mar. 25, 1997

[54] VEHICLE DOOR LOCKING APPARATUS AND CONTROL METHOD THEREFOR

[75] Inventor: Katsuya Kuroda, Yamanashi-ken, Japan

[73] Assignee: Mitsui Kinzoku Kogyo Kabushiki Kaisha, Tokyo, Japan

[21] Appl. No.: 509,987

[22] Filed: Aug. 1, 1995

[30] Foreign Application Priority Data

Aug. 1, 1994 [JP] Japan ..... 6-199057

[51] Int. Cl.[6] ..... E05B 53/00

[52] U.S. Cl. ..... 307/10.2; 292/DIG. 3; 292/DIG. 23; 292/DIG. 25; 70/264; 70/263

[58] Field of Search ..... 307/9.1, 10.1, 307/10.2–10.8; 70/275, 277, 278, 279, 262, 263, 264, 237; 180/287; 340/425.5, 426, 825.69, 825.73, 825.31, 825.34, 825.54; 292/201, 336.3, DIG. 3, DIG. 23, DIG. 25

[56] References Cited

U.S. PATENT DOCUMENTS

| | | | |
|---|---|---|---|
| 4,342,209 | 8/1982 | Kleefeldt | 70/264 |
| 4,452,058 | 6/1984 | Noel | 70/264 |
| 4,887,065 | 12/1989 | Robitschko et al. | 307/10.1 |
| 4,978,154 | 12/1990 | Kleefeldt et al. | 292/201 |
| 5,216,406 | 6/1993 | Bechtle | 307/10.2 |
| 5,250,849 | 10/1993 | Periou | 307/10.1 |
| 5,409,277 | 4/1995 | Rogers, Jr. | 70/264 |
| 5,497,641 | 3/1996 | Linde | 307/10.1 |

FOREIGN PATENT DOCUMENTS 2269850 2/1994 United Kingdom .

*Primary Examiner*—William M. Shoop, Jr.
*Assistant Examiner*—Peter Ganjoo
*Attorney, Agent, or Firm*—Browdy and Neimark

[57] ABSTRACT

A vehicle door locking system comprises a control portion for performing control operations of changing positions of lock levers into locking positions and of changing positions of anti-theft mechanisms into anti-theft positions. The control portion causes sending means to send out a warning signal for a predetermined time period, when a faulty change in position of the lock levers or the anti-theft mechanisms occurs. If a key cylinder or a transmitter is operated during the signal is sent out, the warning signal is stopped even before the predetermined time period has elapsed.

12 Claims, 19 Drawing Sheets

FIG. 1
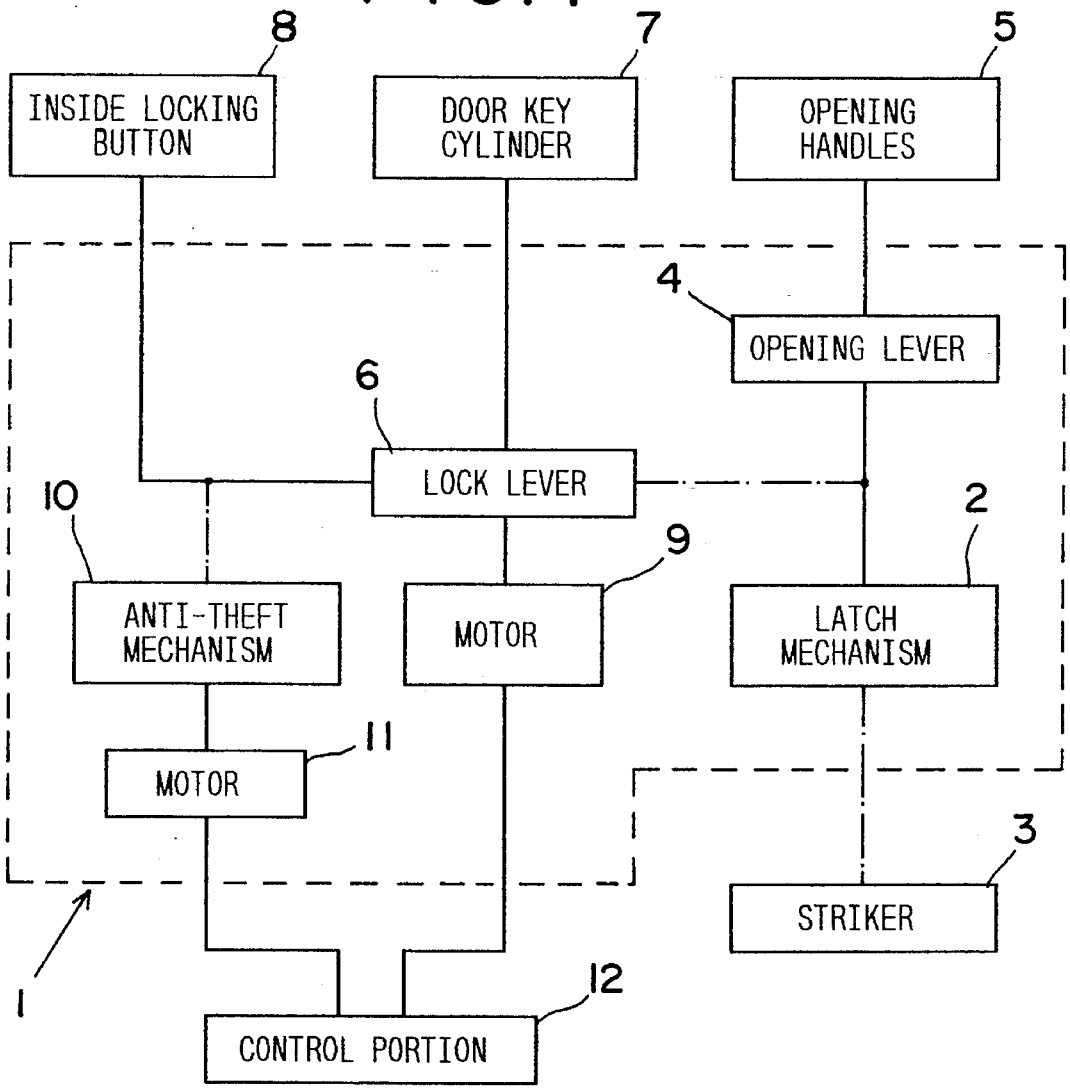
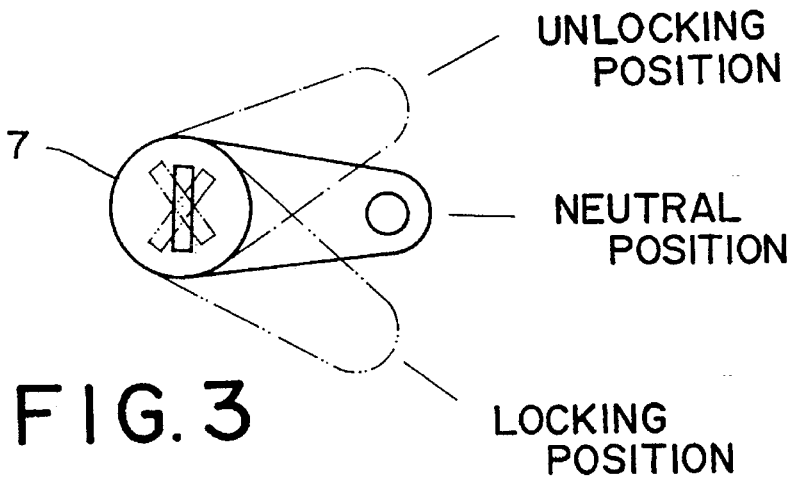
FIG. 3

S/R FOR KEY CY LOCK OP
S101
LOCK SW FAULT FG: SET ?
Y
RETURN
N
S103
SW 14: ON ?
Y
S105
A/LD: UNLOCK
N
S109
L/AD & L/RD: LOCK ALL UNLK FGS: RESET
S107
ALL LOCK FGS: RESET
2
S111
SW 15: ON ?
N
Y
S113
TIMER: START
S177
TIMER: START
S115
KEY CYLINDER LOCKED PSTN ?
N
5
Y
S117
TIMER: UP ?
N
Y
T=1 SEC.
S119
SETTING CONDITIONS OK ?
N
Y
3
9
S179
KEY CYLINDER LOCKED PSTN ?
N
7
Y
S181
KEY CYLINDER AT PSTN ?
Y
S183
TIMER: UP ?
N
Y
T=10 SEC
8

4
10
S137
TIMER: START
S139
KEY CYLINDER LOCKED PSTN ?
Y
N
S141
TIMER: UP ?
N
Y
T=10 SEC.
8
S143
SW FAULT SGL: START
S145
TIMER: START
S147
KEY CYLINDER LOCKED PSTN ?
N
Y
S149
TIMER: UP ?
N
Y
T=2 SEC.
S151
LK SW FAULT FG: SET
S153
SW FAULT SGL: STOP
6
2
S155
ALL LK FGS: SET
RETURN

13
S317
UNLOCK COMPLETION SGL: START
S319
TIMER: START
S321
KEY CYLINDER UNLOCKED PSTN ?
N
Y
S323
KEY CYLINDER LOCKED PSTN ?
Y
N
S325
N
TM SGL RECEIVED ?
Y
S327
N
TIMER: UP ?
Y
T=2 SEC
S329
UNLOCK COMPLETION SGL: STOP
S331
TIMER: START
S333
KEY CYLINDER UNLOCKED PSTN ?
Y
N
15
S335
TIMER: UP ?
N
Y
T=10 SEC
RETURN
14

S/R FOR TM AT OP
S401
ALL SW 16 AND SW 14: OFF ?
N
Y
RETURN
S403
ALL UNLOCK FGS: RESET
S405
TRUNK LID & WINDOW GLASS CLOSED?
N
Y
S407
A/LD: AT TRUNK: LOCK
S409
ALL SW 19: ON ?
N
Y
20
S411
AT COMPLETION SGL: START
S413
TIMER: START
18
S415
KEY CYLINDER OPERATED ?
Y
N
S416
TM SGL RECEIVED ?
Y
N
16
17
S425
A/LD: LOCK
S427
AT REJECTION SGL: START
S429
TIMER: START
S431
KEY CYLINDER OPERATED ?
Y
N
S432
TM SGL RECEIVED ?
Y
N
S433
TIMER: UP ?
N
Y
T=2 SEC
S435
AT REJECTION SGL: STOP
19

VEHICLE DOOR LOCKING APPARATUS AND CONTROL METHOD THEREFOR

BACKGROUND OF THE INVENTION

1. Field of The Invention

The present invention relates to a vehicle door locking apparatus and a control method therefor.

2. Description of The Prior Art

Hitherto, there has been publicly known a door locking apparatus which has a lock lever displaceable between a locking position and an unlocking position by operating a key cylinder provided on the outside of a door or an inside locking button provided on the inside thereof, and an anti-theft mechanism or a super-lock mechanism for disabling the lock lever from being displaced from the locking position to the unlocking position by operating the locking button.

FIG. 12 schematically illustrates a door locking apparatus with an anti-theft mechanism proposed in the U.S. Pat. No. 4,978,154. This door locking apparatus has a lock lever A for changing the state of the apparatus between a locked state and an unlocked state, and a switching body B which can slide laterally from a shaft C and has a projection D at a left end thereof. FIG. 12 shows the switching body B which has been slid rightwardly from the shaft. Thus, the projection D engages with a fork portion E of the lock lever A. The locking apparatus is further provided with a lever H having an elongated hole I with which the projection D engages. A rocking motion of the lever H causes the switching body B to slide from side to side. A top or nut L is screwed on a threaded spindle K which is rotated by a motor J. An outer cylinder M engaging with the lock lever A is engaged with the outer surface of the top L through a lost-motion coupling.

FIG. 12 illustrates a locked state in which the inner top L and the outer cylinder M are leftwardly moved through the rotation of the motor J up to the locking position. In this state, an inside locking button G is coupled to the lock lever A by engaging the projection D of the switching body B with the fork member E of the lock lever A. Thus, the lock lever A can be switched between the locking position and the unlocking position by using the inside locking button G. When the motor is further rotated from the state or position of FIG. 12, the outer cylinder M does not move but the top L singly moves to the left to thereby turn the lever H counterclockwise. Consequently, the switching body B is moved leftwardly. Further, the projection D is disengaged from the fork portion E. Thus the coupling between the inside locking button G and the lock lever A is canceled. This is anti-theft state.

When changing the state of the aforementioned known locking apparatus into the locked state from the unlocking state, the top L should be stopped at the locking position. Thus, if the top L goes beyond the locking position to the left, the state of the locking apparatus is changed into the anti-theft state. Therefore, the locking apparatus is constructed in such a manner that the rotation of the motor is stopped in response to a signal from a sensor N which can detect the locking position of the top L or the cylinder M when the top L or the cylinder M reaches the locking position.

However, even if is stopped energizing the motor J in response to a signal from the sensor N, the motor J turns to no small extent owing to the inertia. Therefore, it becomes very difficult to securely stop the top L at the locking position. Thus, a countermeasure against the excessive rotation of the motor J due to the inertia (for example, a change of the mounting position at which the sensor N is mounted on the locking apparatus) is applied to the locking apparatus. This countermeasure is not very effective, because variations in resistance value of components and in voltage provided by a battery serving as a power supply for the motor J cause a large variation in amount of rotation of the motor J in the case of mass-produced locking apparatuses.

SUMMARY OF THE INVENTION

Accordingly, an object of the present invention is to provide a locking apparatus adapted to issue a warning signal for a predetermined time period if a problem occurs when the state of the apparatus is changed into a locked state or an anti-theft state or when the locked state or the anti-theft state of the apparatus is canceled.

Further, another object of the present invention is to provide a locking apparatus which can change the state thereof into a locked state or an anti-theft state and can cancel the locked state or the anti-theft state thereof in response to the next operation by a driver even while a signal is being issued.

Other features, objects and advantages of the present invention will become apparent from the following description of a preferred embodiment with reference to the drawings in which like reference characters designate like or corresponding parts throughout several views.

BRIEF DESCRIPTION OF THE DRAWINGS

FIG. 1 is a functional block diagram for illustrating the configuration of a locking apparatus for a driver's door;

FIG. 3 is a diagram for illustrating a key cylinder which does not have an anti-theft (hereinafter sometimes abbreviated as AT) position;

DETAILED DESCRIPTION OF THE PREFERRED EMBODIMENT

Figure 2:
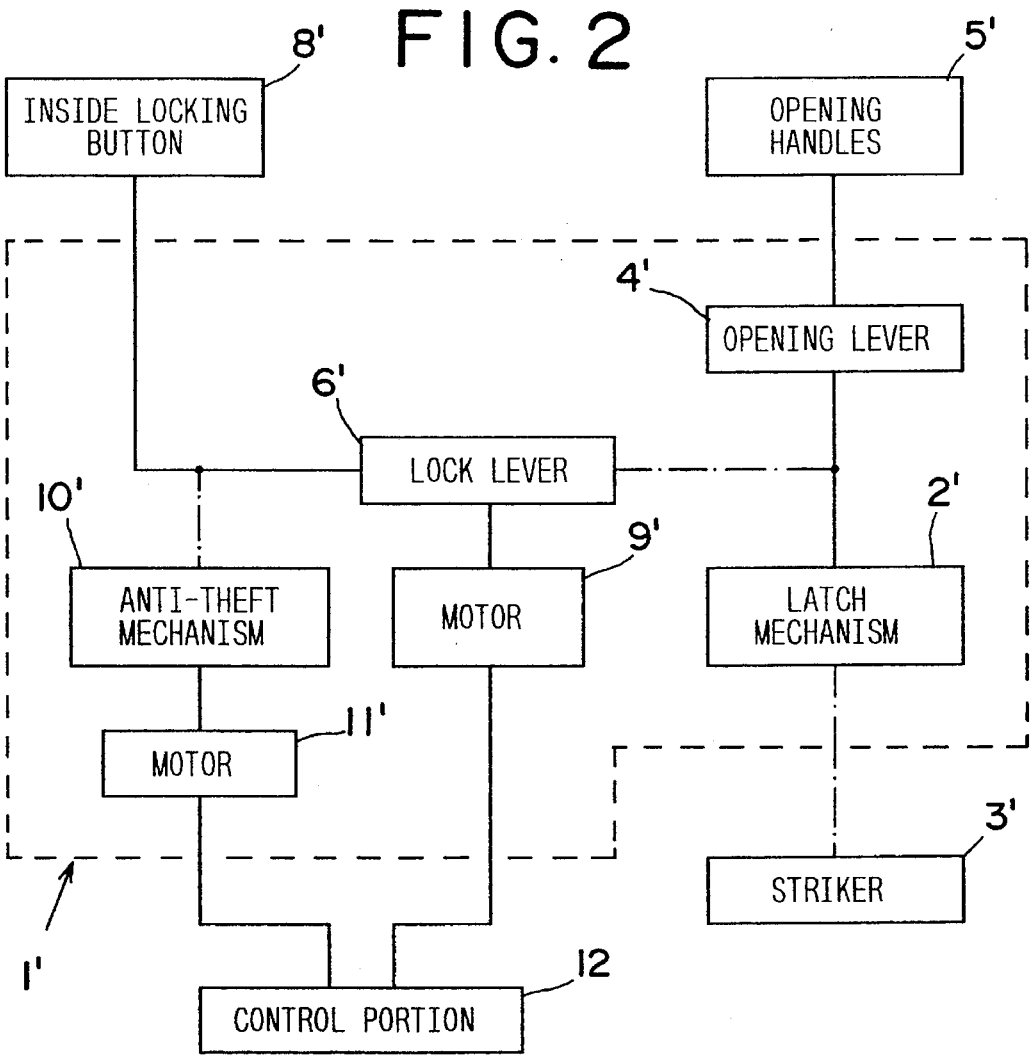
FIG. 2 is a functional block diagram for illustrating the configuration of a locking apparatus for door corresponding to a rear or back seat.

Hereinafter, the preferred embodiment of the present invention will be described in detail by referring to the accompanying drawings. FIG. 1 is a functional block diagram for illustrating the configuration of a locking apparatus 1 mounted on a driver's door. The locking apparatus has a latch mechanism 2, which engages with a striker 3 fixed to a vehicle body when closing a door, and an opening lever 4, which is connected to inner and outer opening handles 5 of the door. When the opening lever 4 turns, the latch mechanism 2 releases the striker 3. Thereby, the door is opened. The locking apparatus 1 further has a lock lever 6 whose position is switched between a locking position and an unlocking position. When the lock lever 6 is in the unlocking position, the opening lever 4 and the latch mechanism 2 are kept in a connected state, namely, kept connected with each other. Thus an operation of opening the door by means of the opening lever 4 can be performed. In contrast, when the lock lever 6 is in the locking position, the opening lever 4 and the latch mechanism 2 come to be in an unconnected state. Thus the operation of opening the door by means of the opening lever 4 is disabled.

The aforementioned locking apparatus 1 further has a door key cylinder 7, which is mounted on the outer surface of the door, an inside locking button 8, which is mounted on the inner surface of the door, and a motor 10 for changing the position of the lock lever 6. In the locking apparatus 1, an AT mechanism 10 and a motor 11 are provided. The AT mechanism 10 is adapted to change its position between an AT position for putting the locking button 8 and the lock lever 6 into an unconnected state and a connection position (namely, an AT canceling position) for keeping the lock lever 6 and the locking button 8 in a connected state by the motor 11. When the AT mechanism is in the AT position, the lock lever 6 comes to be unable to be moved even if an unlocking operation is performed on the locking button 8. The control portion 12 controls the rotary motions of each of the motors 9 and 11. Incidentally, a single motor can serve as both of the motors 9 and 11 (see GB 2,284,232A).

FIG. 2 is a functional block diagram for illustrating a locking apparatus 1' mounted on a rear seat. This locking apparatus 1' is different from the locking apparatus 1 of FIG. 1 in that no key cylinder is connected to a lock lever 6'. The rest of the configuration of the locking apparatus 1' is basically the same as that of the configuration of the locking apparatus 1. Further, the configuration of a locking apparatus mounted on an assistant driver's door is the same configuration as of the locking apparatus 1 for use on a driver's door. Therefore, the illustration and description of the locking apparatus mounted on the assistant's door are omitted herein.

Only one control portion 12 is provided in a motor vehicle. The control portion 12 controls the rotary motions of all motors of each of the locking apparatuses 1 and 1' in response to operations of the key cylinder 7 and a remote control transmitter 22 (to be described later (see FIG. 5)).

Figure 4:
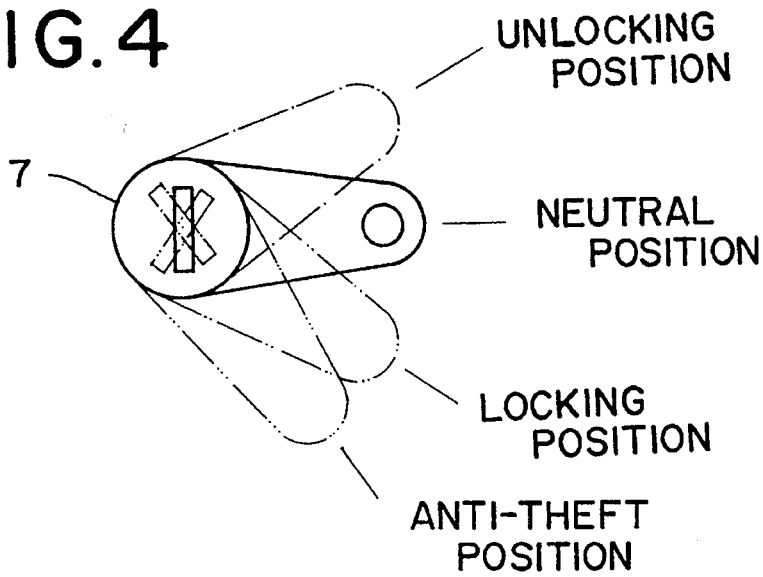
FIG. 4 is a diagram for illustrating a key cylinder which has an AT position.

FIG. 3 shows a first example of the key cylinder 7. This key cylinder 7 has a locking position and an unlocking position respectively placed on both of the sides of a neutral position but does not have an additional position for an anti-theft operation. When an anti-theft operation signal is transmitted to the control portion 12 by using this key cylinder 7, this key cylinder 7 is held at the locking position against the resilience of a spring (not shown) for a predetermined time period, preferably, for a time period equal to or longer than 1 second. Then, a switch 13 for detecting each of the positions of the key cylinder 7 (see FIG. 5) transmits a continuous locking signal to the control portion 12. If this locking signal is sustained for a time period longer than the predetermined time period, the control portions 12 activate the motors 11 and 11' and changes the positions of the AT mechanisms 10 and 10' into the AT positions, respectively. FIG. 4 shows a second example of the key cylinder 7 which has an anti-theft position in addition to a locking position and an unlocking position.

Figure 5:
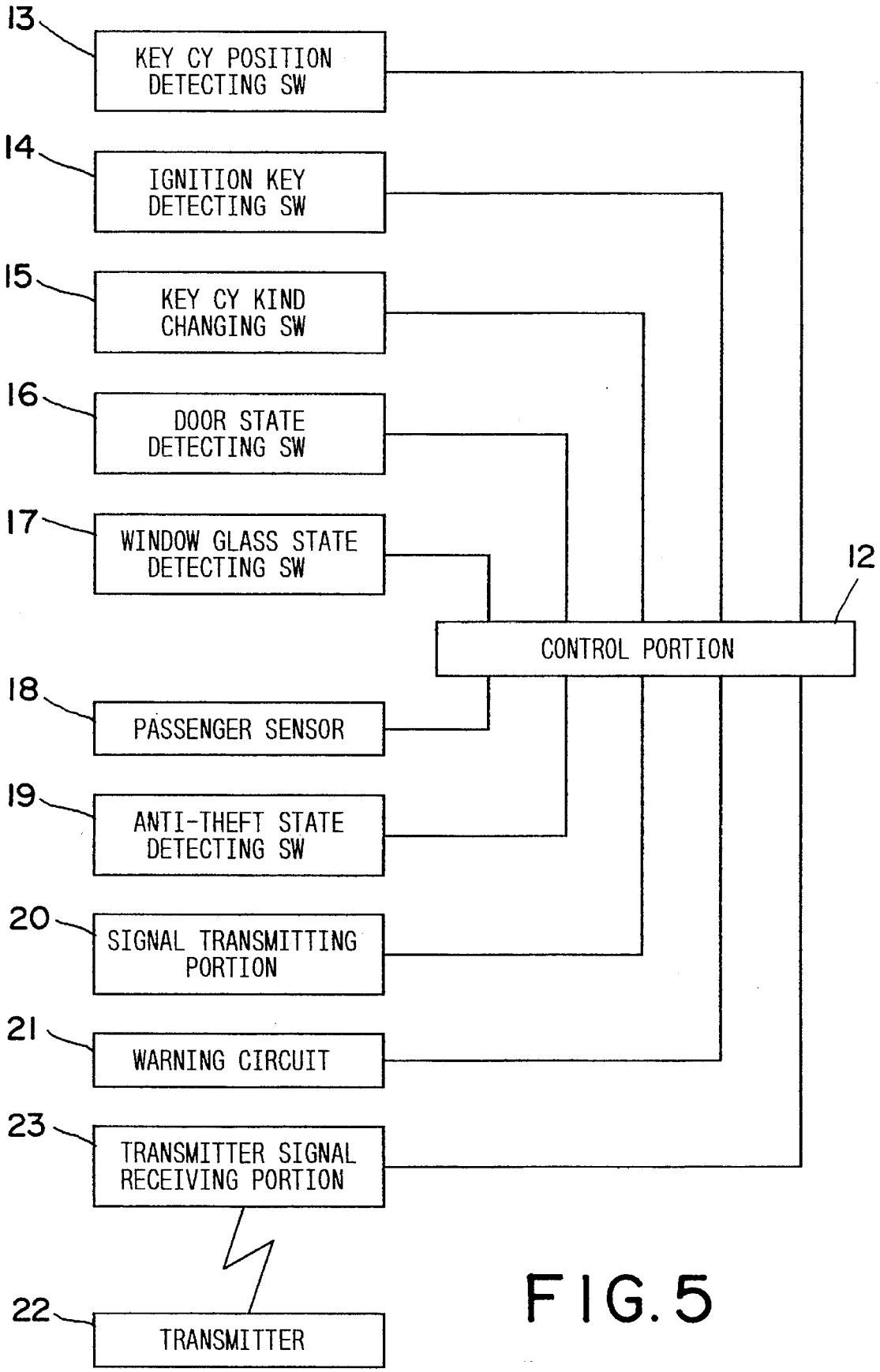
FIG. 5 is a block diagram for illustrating the configuration of various kinds of switches.

As shown in FIG. 5, many switches and sensors are connected to the control portion 12. Reference numeral 14 designates a switch adapted to be turned on when a key is inserted into an ignition key cylinder (not shown); and 15 a switch whose state can be manually changed according to the kind of the door key cylinder 7. In the case where the key cylinder 7 of FIG. 3 is used, the switch 15 is preliminarily turned on. Conversely, in the case where the key cylinder 7 of FIG. 4 is used, the switch 15 is preliminarily turned off. Further, reference numeral 16 denotes a plurality of switches which are turned on when the door is opened; 17 a plurality of switches which are turned on when a window is opened; 18 a sensor which is turned on when someone is in the inside of the motor vehicle; 19 a plurality of switches which are turned on when each of the AT mechanisms 10 and 10'is in the AT position; and 20 a signal transmitting portion (namely, a speaker) for issuing a warning sound and a confirming sound. The sounds issued from the signal transmitting portion 20 are distinguished from each other according to intended use or purpose by changing the frequency, the degrees of loudness, the duration thereof and so on. Moreover, reference numeral 21 designates a warning circuit (namely, an alarm circuit) which is set by the control portion 12 if a predetermined condition is met. If the inside locking button 8 is operated during the warning circuit 21 is set, the warning circuit 21 issues a warning sound. Conditions for setting the warning circuit 21 (hereunder sometimes referred to simply as setting conditions) are met if all of the switches 14, 16, 17 and 18 are turned off. The setting conditions are used as those for changing the position of the AT mechanism into the AT position.

Next, the details of a control operation of the locking apparatus for the driver's door will be described hereinbelow by referring to a plurality of flowcharts of FIGS. 6A, 6B to 11. In these flowcharts, the following designations listed below will be used for simplicity of drawing.

| Designation | Meaning |
|---|---|
| KEY CY | Key Cylinder of Driver's Door |
| L/DD | Locking apparatus of Device of Driver's Door |
| L/AD | Locking apparatus of Assistant's Door |
| L/RD | Locking apparatuses of Rear Doors |
| A/LD | All Locking apparatuses |

Figure 6A:
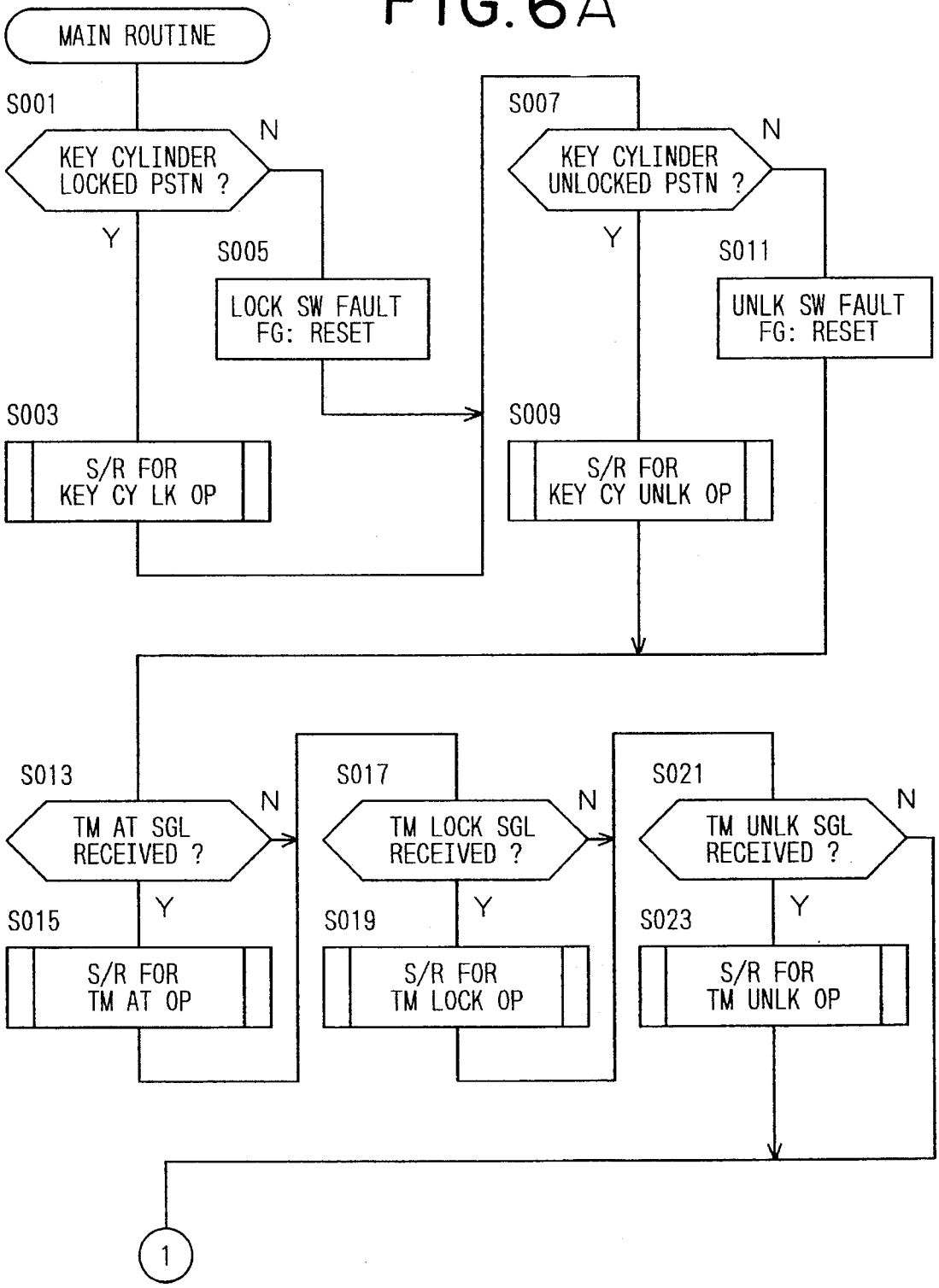
FIGS. 6A and 6B are flowcharts of a main routine to be executed by a control portion, which concerns an operation of a key cylinder of the driver's door and that of a transmitter.
Figure 6B:
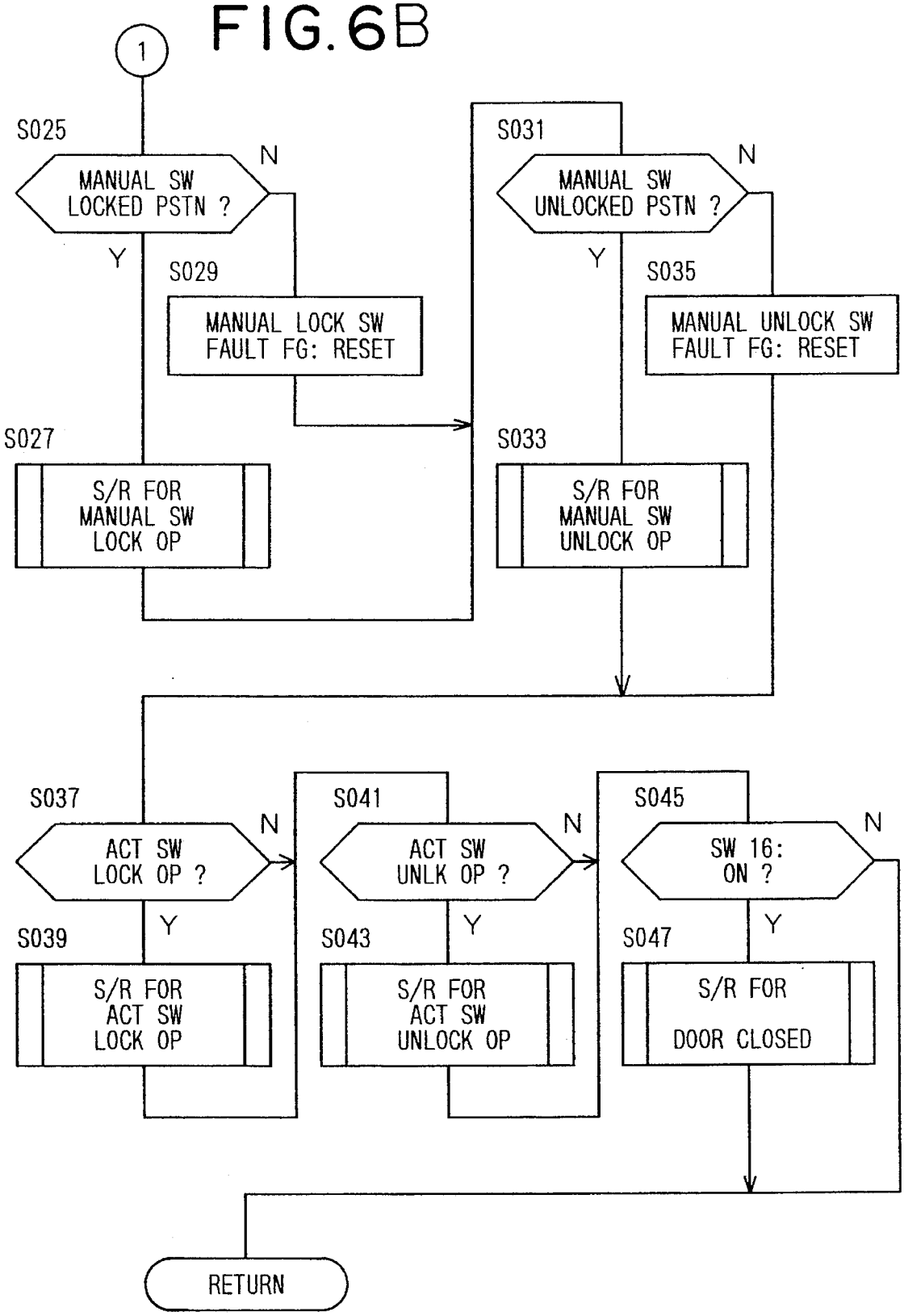
Figure 7A:
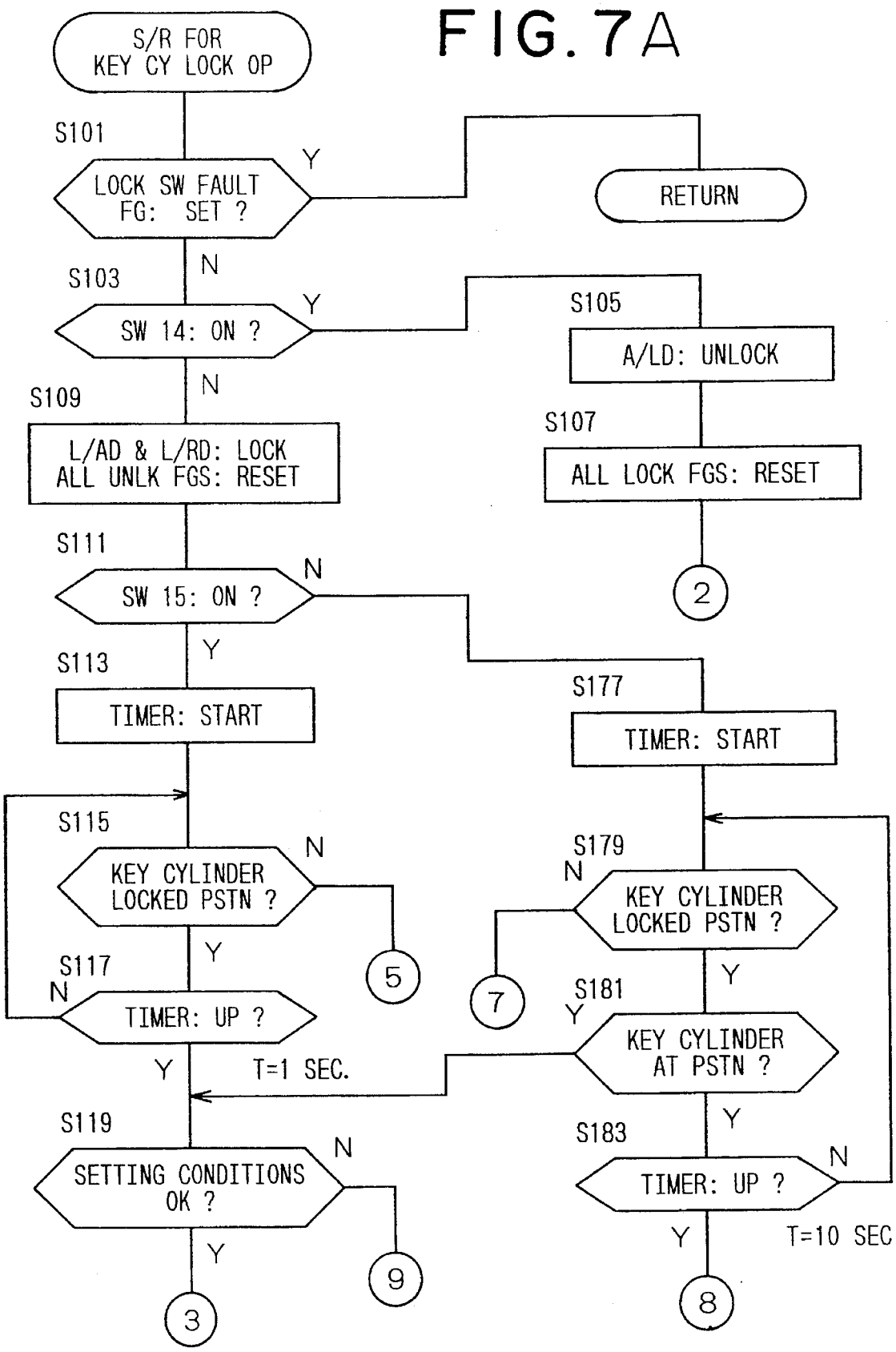
FIGS. 7A to 7E are flowcharts of a subroutine to be executed when locking the key cylinder of the driver's door.
Figure 7B:
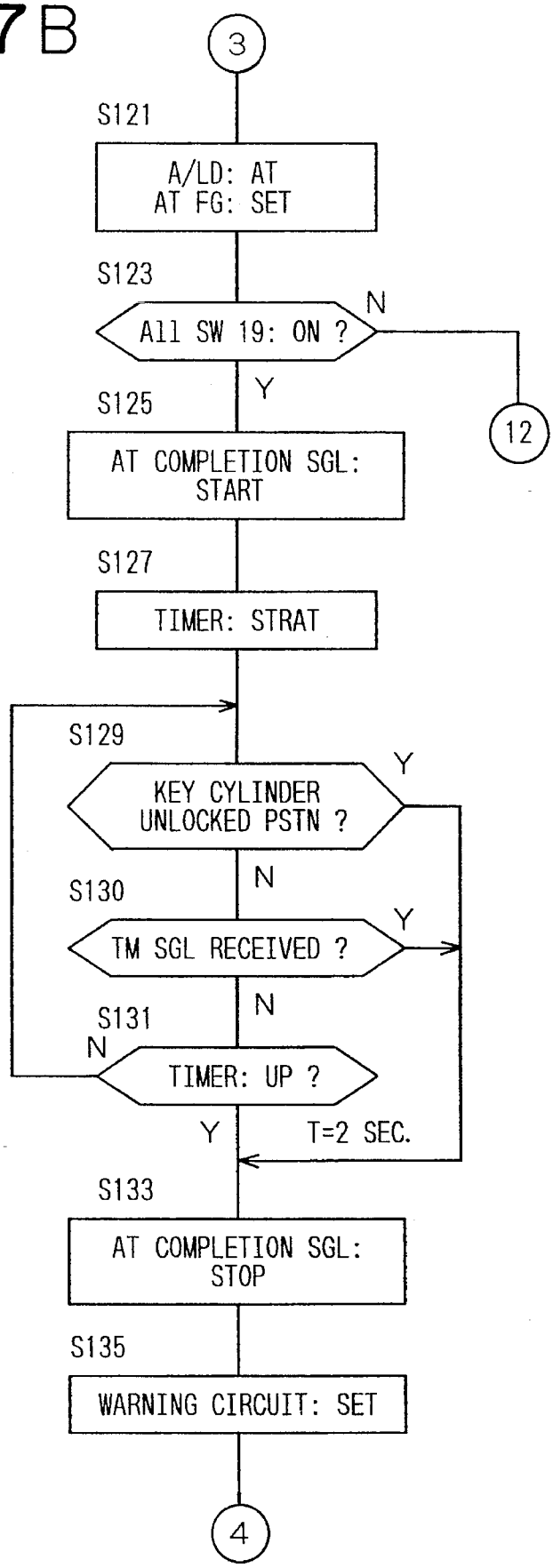
Figure 7C:
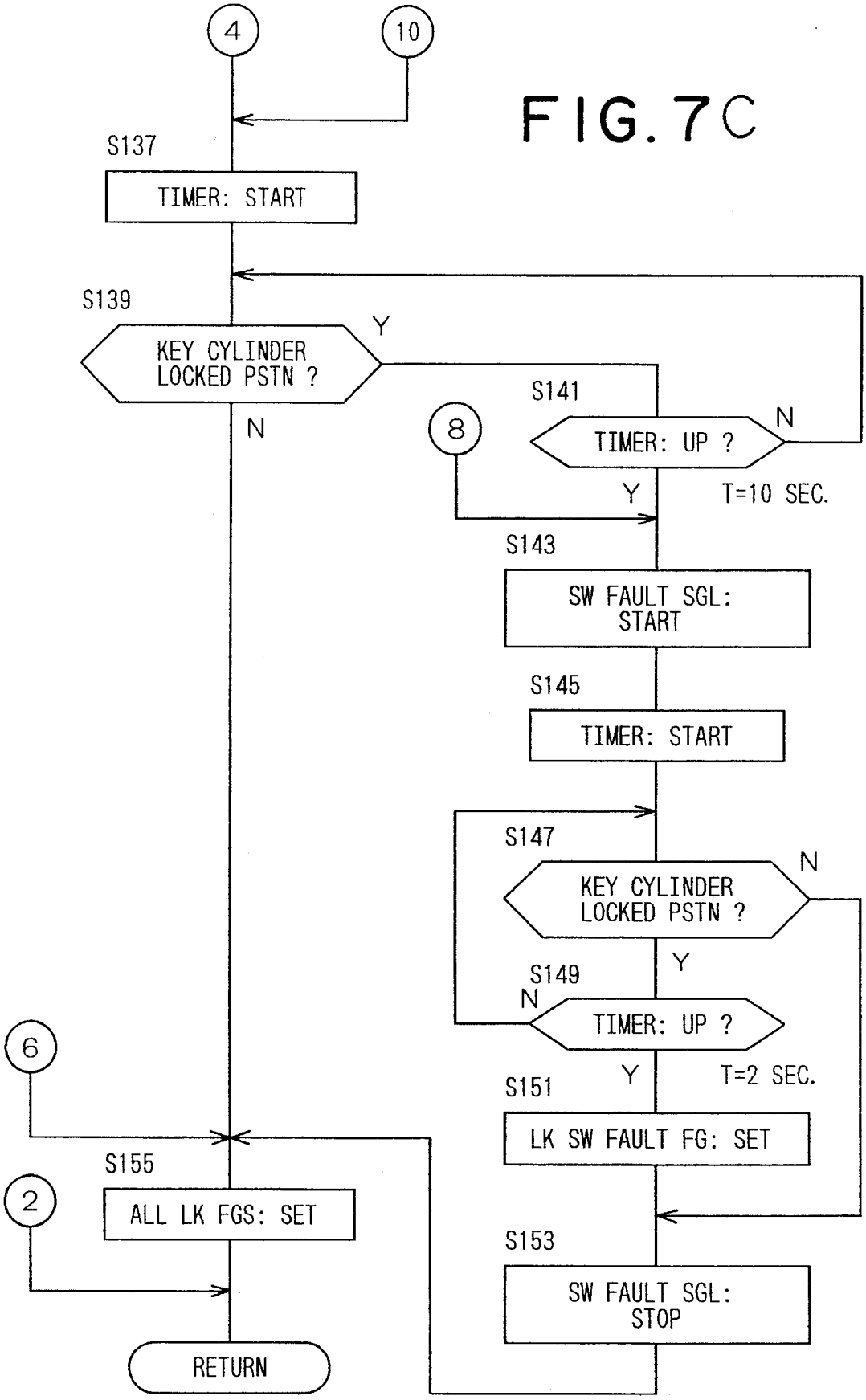
Figure 7D:
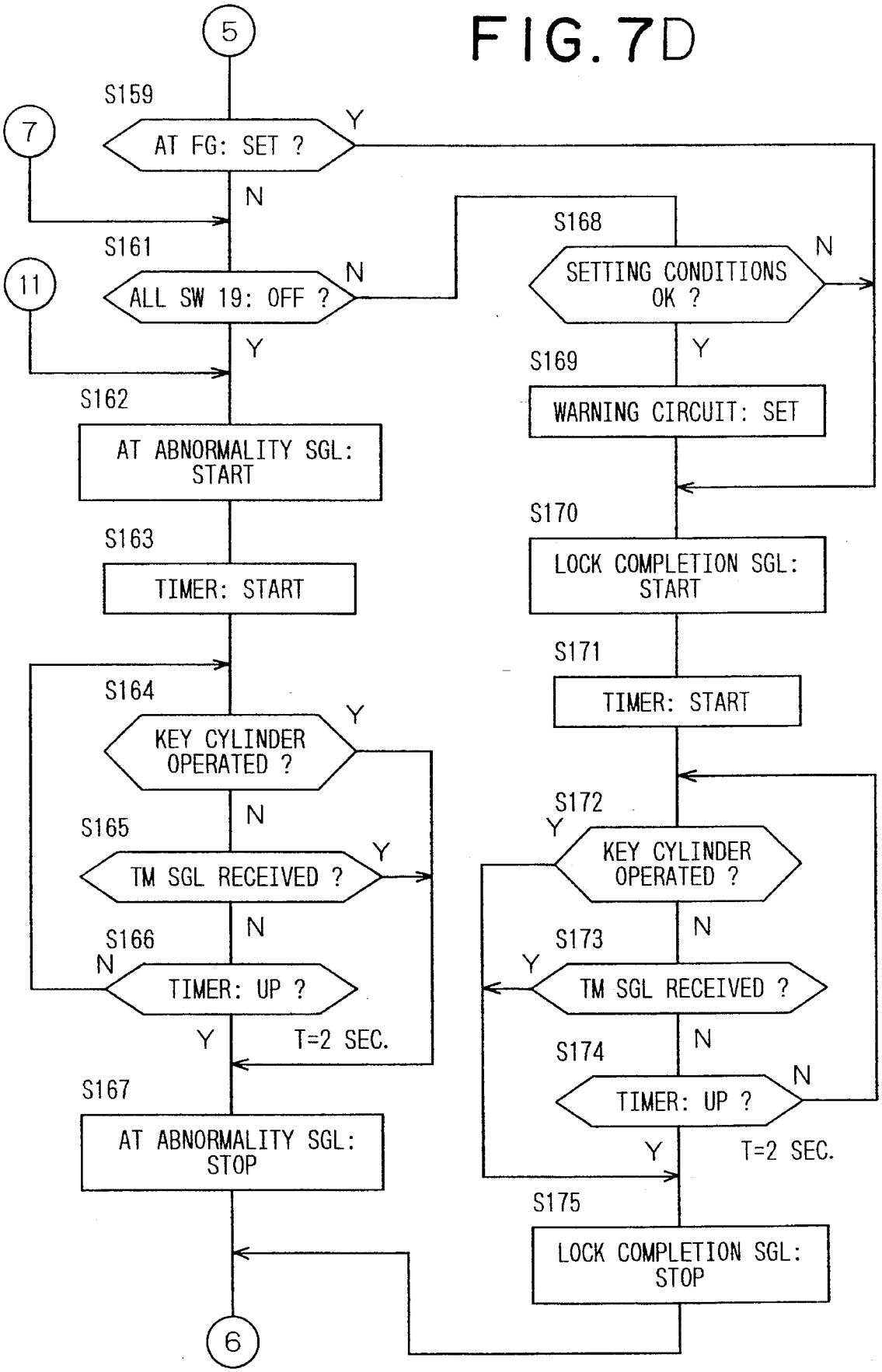
Figure 7E:
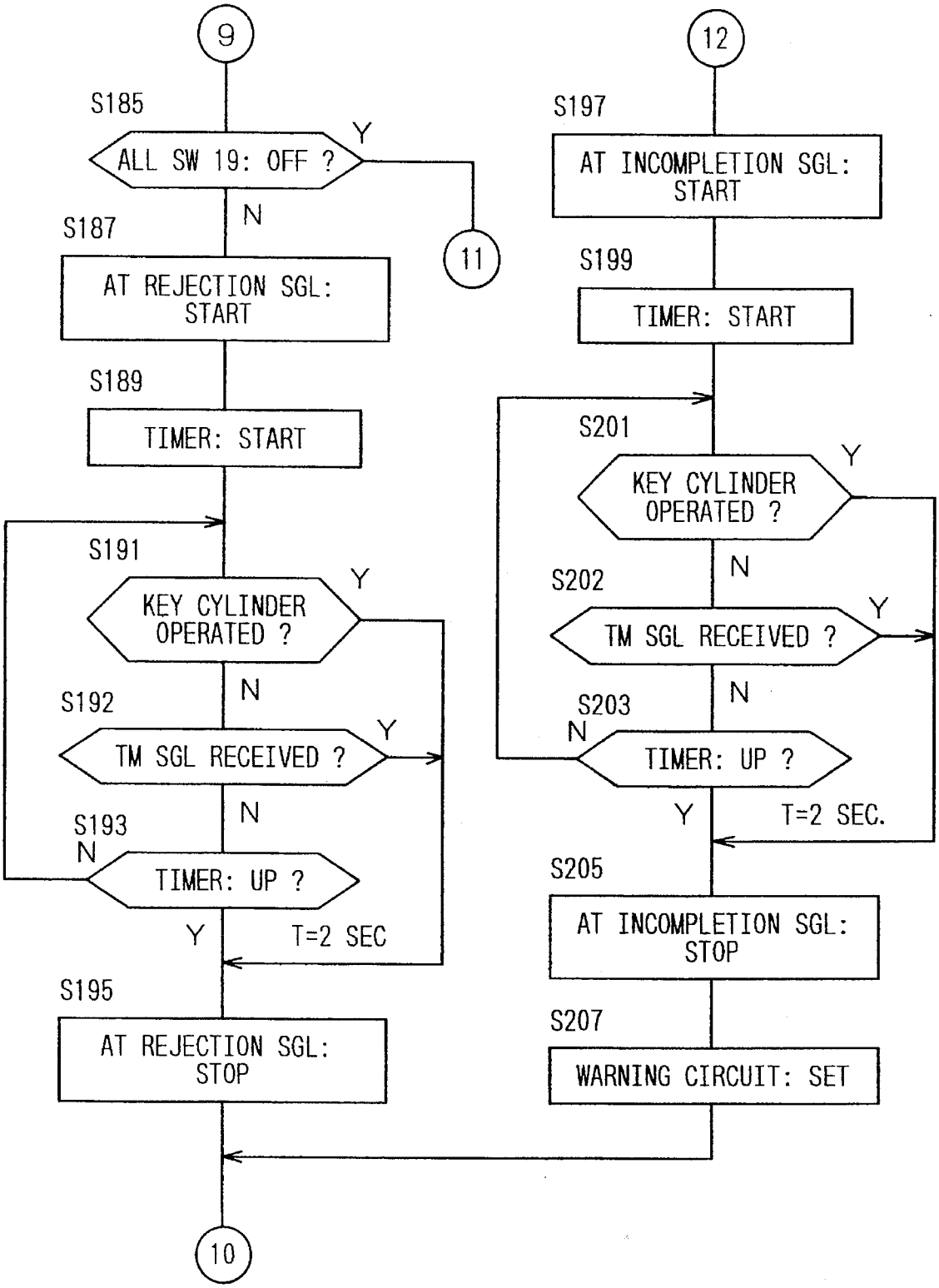

FIGS. 6A and 6B illustrate a main routine to be executed by the control portion 12, which consists of many subroutines. When a locking operation is performed on the key cylinder 7 of the driver's door, the switch 13 detects the locking position of the key cylinder 7 in step S001. Further, the control of the control portion 12 is passed to the "Subroutine for driver's door key cylinder locking operation" of FIGS. 7A to 7E which will be described hereinbelow.

Driver's Door Key Cylinder Locking Operation

When the control of the control portion 12 is passed to the subroutine of FIGS. 7A to 7E, it is first checked in step S101 whether or not a "lock switch fault flag" is set. This flag is a flag to be set when a function disorder occurs in the switch 13 for detecting the locking position of the key cylinder 7. When this flag has been set, the control of the control portion 12 is immediately returned to the main routine. Incidentally, it is judged in steps S137 to S153 of FIG. 7C (to be described later) whether or not a failure or fault of the switch 13 occurs.

When the fault flag has not been set, the control portion checks in step S103 through the switch 14 whether or not a key is inserted into an ignition key cylinder. If the key is detected, it is inconvenient for locking. Therefore, the lock levers of all of the locking apparatuses are put back to the unlocking positions by means of the motors 9 and 9', respectively, in step S105. Subsequently, each "lock flag" which is to be set when each of the lock levers is turned to the locking position, is reset in step S107. Thus the control of the control portion returns to the main routine.

If no key is detected in step S103, the lock levers of the assistant's door and the rear doors are changed into the locking positions. Further, "unlock flags" of all of the locking apparatuses are reset in step S109. The unlock flag is a flag to be set when the lock lever is turned to the locking position. Incidentally, the lock lever corresponding to the driver's door has already been changed into the locking position by operating the key cylinder 7. Further, the setting of the lock flag is performed at the end of this subroutine, namely, in step S155 of FIG. 7C.

Upon completion of the locking, the control portion 12 checks the kind of the key cylinder 7 through the switch 15 in step S111. First, an operation in the case where the switch 15 has been turned on will be described hereunder. In this case, the key cylinder 7 of FIG. 3, which has no AT position, is used. When an anti-theft operation signal is sent to the control portion 12 by means of this key cylinder 7, a driver holds the key cylinder 7 at the locking position for a predetermined time period, preferably, for a time period equal to or longer than 1 second. The control portion 12 activates a timer for measuring a time period of 1 second in step S113 so as to detect the locking operation. During the timer operates, the position of the key cylinder 7 is continuously monitored by the switch 13 in step S115. In the case where the key cylinder 7 is put back to the neutral position before a timer runout is detected in step S117, the driver is regarded as having not selected the AT operation. The control is passed to an operation of step S159 of FIG. 7D. Further, a control operation for terminating the execution of the subroutine is performed, though this control operation will be later described in detail.

In contrast, when the key cylinder is held in the locking position for a time period equal to or longer than 1 second, the control portion 12 regards the driver as having selected the anti-theft operation. Thereby, the control portion 12 verifies in step S119 whether or not the setting conditions are met. These conditions are satisfied if all of the switches 14, 16, 17 and 18 are turned off. Conversely, if at least one of these switches is turned on, the control portion 12 regards the state of the vehicle as can not be changed into the anti-theft state, and rejects the change of the state of the vehicle into the anti-theft state.

If the setting conditions are met, the control portion 12 changes the positions of the AT mechanisms 10 and 10' of all of the locking apparatuses into the AT positions. Further, the control portion 12 sets an "anti-theft flag" in step S121. The AT flag is a flag to be set when the control portion issues to the motors a command that the positions of the AT mechanisms are changed into the AT positions. Here, note that the setting of the AT flag does not assure that the position of the AT mechanism has been changed into the AT position. If the AT flag is set, the control portion verifies in step S123 whether or not the position of each of the AT mechanisms has been changed into the AT position, for cautions's sake. Then, the sending of an anti-theft completion signal is started in step S125. Incidentally, this signal is sent out, in steps S127 and S131, for a time period set by the timer. During transmitting this signal, the control portion 12 monitors an unlocking operation of the key cylinder 7 in step S129 and further monitors an operation of the transmitter in step S130. If one of these operations is detected, the transmission of the signal is immediately stopped in step S133 even prior to the timer runout. Subsequently, the control portion sets the warning circuit 21 in step S135. The conditions necessary for setting the warning circuit 21 have been verified in step Sl19.

The process consisting of steps S137 to S153 is a process of judging whether or not the failure of the switch 13 occurs. In this process, first, the timer for measuring a time period of 10 seconds is activated in steps S137 and S141. During this, the control portion verifies the position of the key cylinder 7 by means of the switch 13 in step S139. As a result, even if the time period of 10 seconds has passed or elapsed, when the locking position of the key cylinder 7 is detected, the control portion judges that the failure of the switch 13 occurs. Usually, a driver, who has turned the key cylinder to the locking position for the purpose of performing the AT operation, puts back the key cylinder to the neutral position from the locking position at a stage in which the driver hears a sound corresponding to the AT completion signal of step S125. Then, the control portion produces the sound corresponding to a switch fault signal in step S143. When a time period set by another timer has passed (steps S145 and S149), the lock switch fault flag is set in step S155. Subsequently, the control returns to the main routine. Namely, if the lock switch fault flag is set, the control, which has been passed to this subroutine by detecting the locking position of the key cylinder in the main routine, comes to be immediately returned to the main routine through step S101. Incidentally, the fault flag is reset in steps S001 and S005 when the locking position of the key cylinder comes not to be detected in the main routine.

However, if the switch 13 comes not to detect the locking position of the key cylinder (in step S147) during the timer operates (steps S145 and S149), the switch 13 is regarded as normal and thus the fault flag is not set.

Next, the remaining steps corresponding to each branch will be described hereinafter.

(Branch from Step Sl15)

In the case where the driver's operation of locking the key cylinder is finished in a time period of less than 1 second, the states of the locking apparatuses are not changed into the AT states. Further, the control is passed to step S159 of FIG. 7D, whereupon the control portion checks the AT flag. The AT flag is a flag to be set when the control portion 12 instructs the motors to changes the states of the locking apparatuses into the AT states. Thus, at this point in time, normally, the AT flag is not set. A case, in which the AT flag is set, corresponds to the case that a locking operation is performed again on the locking apparatus, which has been in the AT state, by means of the key. In this case, the transmission or sending of a lock completion signal is started in step S170. When a time period has passed (steps S171 and S174), the transmission of this signal is stopped in S175 and the control is returned to the main routine through step S155.

However, if an operator operates the key cylinder (in step S172) or the transmitter (in step S173) during the timer operates, the transmission of the signal is immediately stopped in step S175 even prior to the timer runout. Moreover, the control returns to the main routine. Furthermore, the control is passed to the subroutine for operating the key cylinder or the transmitter and subsequently, this subroutine is executed.

In the case where the AT flag is not set in step S159, it is verified in step S161 whether or not at least one of the AT mechanisms 10 and 10' changes the position thereof into the AT position. Hereat, the AT flag is not set. Therefore, normally, neither of the AT mechanism 10 and 10' have changed their positions into the AT positions. However, in extremely rare cases, the change in position of one of the AT mechanisms may occur owing to a malfunction of the locking apparatus, a shock caused by an accident, and so forth. Thus, if it is detected in step S161 that the position of one of the AT mechanisms has been changed into the AT position, the sending of an AT abnormality signal is started in step S162. When the time period set by the timer has passed (steps S163 and S166), the sending of this signal is stopped in step S167. Further, the control is returned to the main routine through step S155.

However, if an operator operates the key cylinder (in step S164) or the transmitter (in step S165) during the timer operates, the transmission of the signal is immediately stopped in step S167 even prior to the timer runout. Moreover, the control returns to the main routine. Furthermore, the control is passed to the subroutine for operating the key cylinder or the transmitter and subsequently, this subroutine is executed.

If it is not detected in step S161 that the position of one of the AT mechanisms has been changed into the AT position, this fact indicates that a normal locking operation is finished. Thus, it is verified in step S168 whether or not the setting conditions are met. If all of the setting conditions are satisfied, the warning circuit 21 is set in step S169. Subsequently, the previously described lock completion signal or the like is controlled. Thus the lock flag is set in step S155. The control is returned to the main routine.

(Branch from Step S111)

Hereinafter, an operation of the case, in which the key cylinder 7 is adapted to have or take the AT position and the switch 15 is preliminarily turned off, will be described. Incidentally, in this case, when the key cylinder 7 is in the AT position, the switch 13 for detecting the position of the key cylinder sends out a signal indicating that the "AT position" and the "locking position" are detected.

If the switch 15 is turned off in step S111, the timer is activated in step S177. Further, the position of the key cylinder is verified by using the switch 13 in steps S179 and S181. When the driver first turns the key cylinder to the locking position and then returns the key cylinder to the neutral position quite normally, it is detected for a short time period (probably, about 0.5 seconds) that the key cylinder is in the locking position. Therefore, the locking position of the key cylinder is detected in step S179, but it is not detected in step S181 that the key cylinder is in the AT position. Thus, when the locking position comes not to be detected, the control is passed to step S161 of FIG. 7D. As previously described, the lock completion signal is sent out after it is verified whether or not the states of the locking apparatuses are erroneously changed into the AT states. Subsequently, the control is returned to the main routine.

In contrast, in the case where the driver first turns the key cylinder to the AT position and then returns the key cylinder to the neutral position quite normally, both of the locking position and the AT position are detected. Thus, the control is passed directly to step S119 from step S181. As previously described, the states of the locking apparatuses are changed into the AT states.

Further, in the case where only the locking position is continuously detected until the timer runout occurs, it is suspected that the failure of the switch 13 may occur. Thus the control is passed to step S143.

(Branch from Step S119)

Hereinafter, the case, in which the setting conditions are not met in step S119, will be described. In step S119, the setting conditions are used as conditions for changing the states of the locking apparatuses into the AT states. When the setting conditions are not satisfied, the window glass or the door is open. Therefore, it is not appropriate to change the states of the locking apparatuses into the AT states. Thus, after it is verified for caution's sake in step S185 whether or not at least one of the AT mechanisms 10 and 10' changes the position thereof to the AT position owing to some abnormality, the sending of an AT rejection signal is commenced in step S187. Thereafter, when the time period set by the timer has passed (steps S189 and S193), the sending of the AT rejection signal is stopped in step S196. Subsequently, a judgement on the failure of the switch 13 and so on are made. Then, the control is returned to the main routine.

However, if the operator operates the key cylinder (in step S191) or the transmitter (in step S192) during the timer operates, the sending of this signal is immediately stopped in step S195 even prior to the timer runout. Moreover, the control returns to the main routine. Furthermore, the control is passed to the subroutine for operating the key cylinder or the transmitter and subsequently, this subroutine is executed. Incidentally, if at least one of the AT mechanisms 10 and 10' has changed the position thereof into the AT position in step S185, the control is passed to step S162. Thereafter, the AT abnormality signal is sent out, and the control is passed to the main routine.

(Branch from Step S123)

Hereinafter, the case, in which one of the switches 19 is turned off in step S123, will be described. In the previous step S121, the control portion 12 instructs the motors 11 and 11' to change the positions of the AT mechanisms 10 and 10' into the AT positions. However, if the position of the AT mechanism of one of the doors is not changed into the AT position by any chance, the control is passed to step S197 of FIG. 7E, whereupon the sending of an AT incompletion signal is started. When the time period set by the timer has passed (steps S199 and S203), the sending of this signal is stopped in step S205. Thereafter, the warning circuit 21 is set in step S207. Then, a judgement on whether or not the failure of the switch 13 occurs, and so forth are made. Subsequently, the control is returned to the main routine.

However, if the operator operates the key cylinder (in step S201) or the transmitter (in step S202) during the timer operates, the sending of this signal is immediately stopped in step S205 even prior to the timer runout. Thereafter, a warning circuit 201 is set in step S207. Subsequently, the control returns to the main routine. Further, the control is passed to the subroutine for operating the key cylinder or the transmitter and subsequently, this subroutine is executed. Incidentally, if at least one of the AT mechanisms 10 and 10' has changed the position thereof into the AT position in step S185, the control is passed to step S162. Thereafter, the AT abnormality signal is sent out, and the control is passed to the main routine.

Driver's Door Key Cylinder Unlocking Operation

Figure 8A:
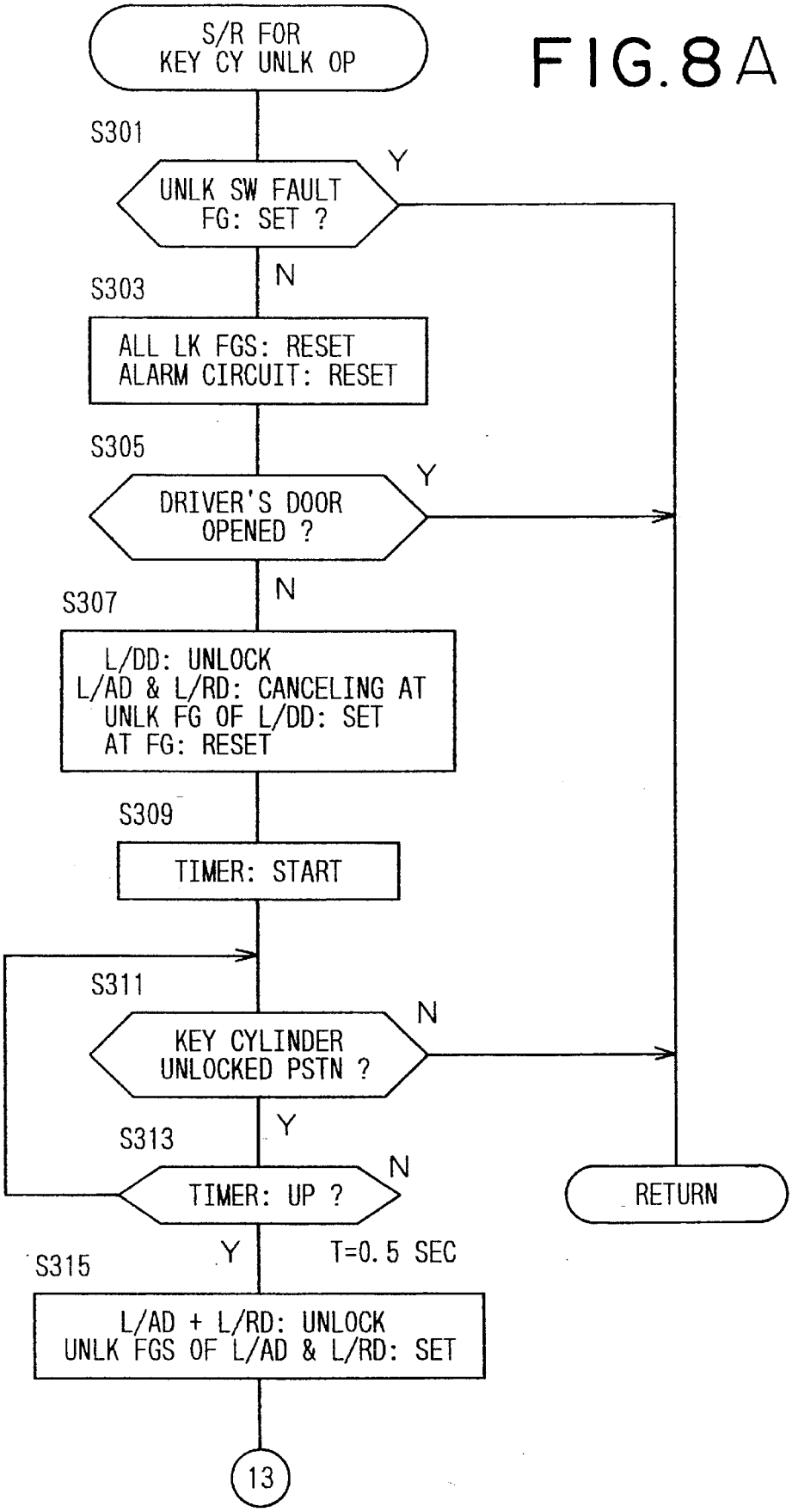
FIGS. 8A to 8C are flowcharts of a subroutine to be executed when unlocking the key cylinder of the driver's door.
Figure 8B:
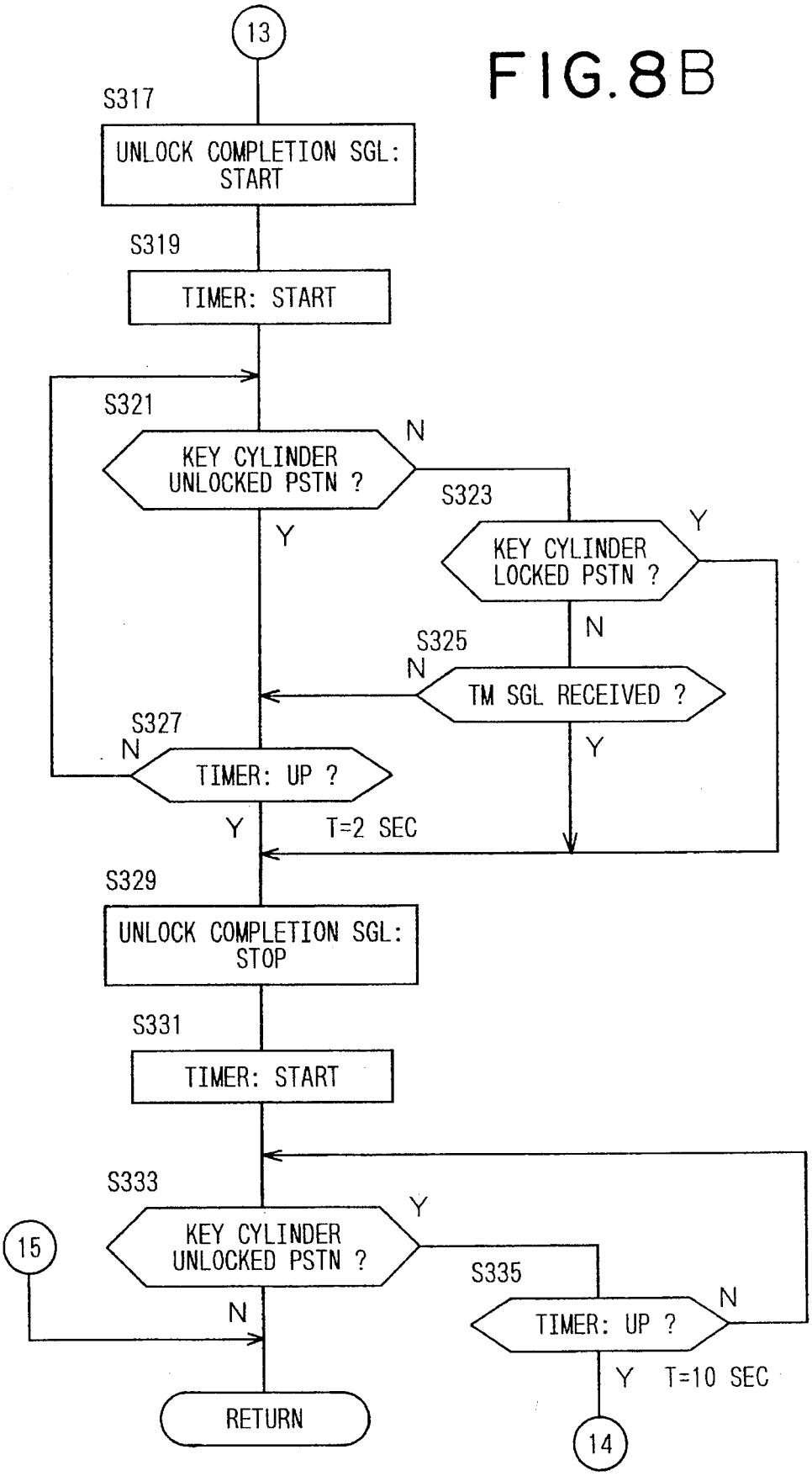
Figure 8C:
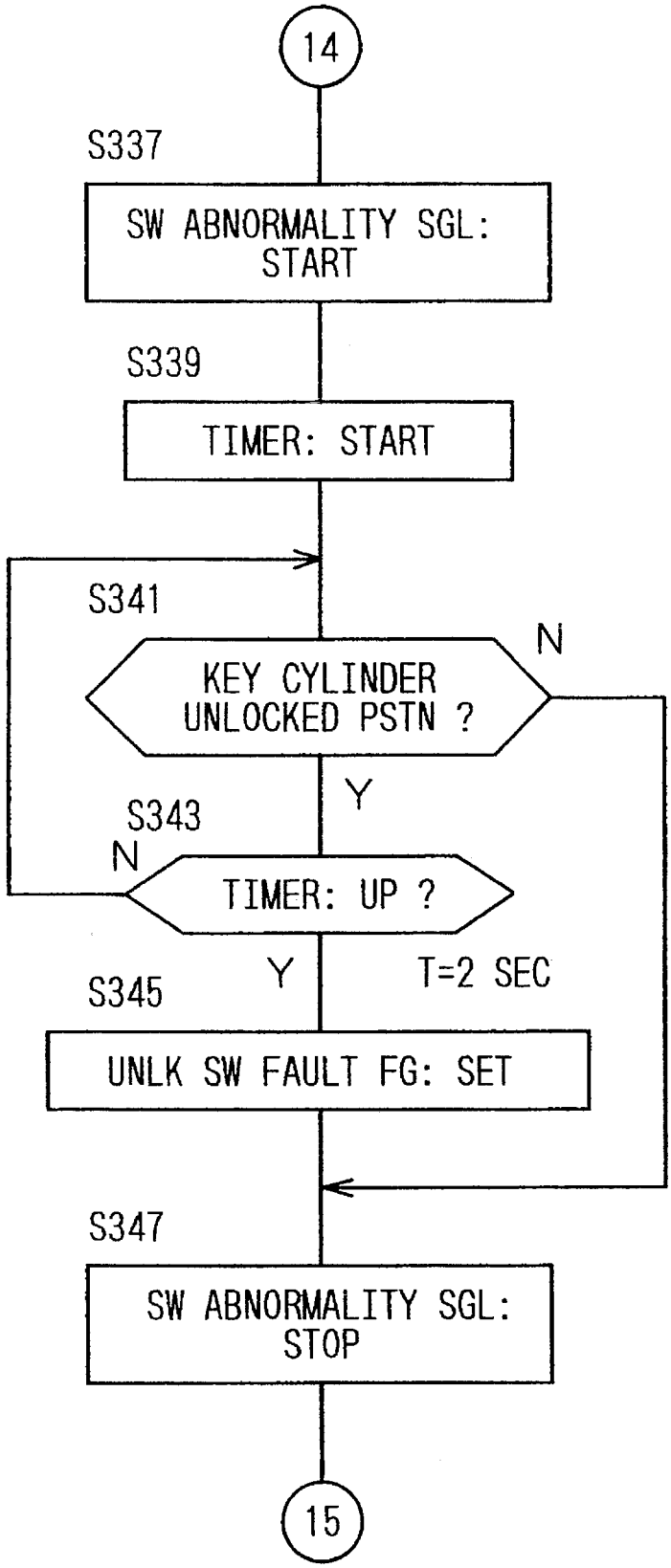

When the switch 13 detects the unlocking position of the key cylinder 7 in step S007 of the main routine, the control is passed or switched to a subroutine for the driver's door key cylinder unlocking operation of FIGS. 8A to 8C.

In this subroutine, it is first verified in step S301 whether or not an "unlock switch fault flag" is set. This fault flag is a flag to be set when the function disorder of the switch 13 for detecting the unlocking position of the key cylinder 7 occurs. When this fault flag is not set, the unlocking position detecting function of the switch 13 is regarded as being normal. Thus this subroutine is executed continuously.

Next, in step S303, the lock flag and the warning circuit are reset as a preprocessing. Subsequently, it is checked in step S305 whether or not the driver's door is open. When this door is open, the unlocking has already been performed on this door. Thus, the control is returned to the main routine without performing anything else. In contrast, when the door is closed, the positions of the lock lever 6 and the AT mechanism 10, which correspond to the driver's door, are changed into the unlocking position and the connecting (or canceling) position, respectively. Further, the positions of the AT mechanisms respectively corresponding to the remaining doors are changed into the connecting positions. Simultaneously, the AT flag is reset. The unlock flag corresponding to the driver's door is set in step S307. Subsequently, the timer is activated in step S309. During this timer operates, the position of the key cylinder 7 is monitored in step S311. When the key cylinder 7 is continuously in the unlocking position until the timer runout, the driver is regarded as having intentionally instructed to unlock the remaining doors. Thus the positions of the locking levers of the remaining doors are changed into the unlocking positions and moreover, the corresponding unlock flags are set in step S315. In the case where the unlocking operation is continuously performed on the key cylinder 7 in this way, the canceling of the anti-theft states and the unlocking of the remaining doors are performed. However, if the key cylinder 7 is put back to the neutral position prior to the timer runout, the control is returned to the main routine without performing anything else. Thus the unlocking of the remaining doors is not performed.

Upon completion of the unlocking of all of the locking apparatuses, an unlock completion signal is sent out in step S317, and the timer is activated in step S319. During the timer operates, the unlocking position of the key cylinder, the locking position of the key cylinder and an operation of the transmitter are monitored in steps S321, S323 and S325, respectively. If it is detected in step S321 that the key cylinder is in the unlocking position, the failure of the switch 13 is suspected. The sending of the signal is continued until the timer runout. Thereafter, the timer for measuring a time period of 10 seconds is activated again in steps S331 and S335. Then, it is judged in step S333 whether or not the failure of the switch 13 occurs. If the switch 13 is judged to be faulty, the sending of the switch abnormality signal is started in step S337. When the time period set by the timer has passed (steps S339 and S343), the unlock switch fault flag is set in step S345. Thereafter, the sending of this signal is stopped in step S347.

When the key cylinder being in the locking position or the transmitter being operated is detected in step S323 or S325, the sending of this signal is immediately stopped in steps S329. Subsequently, the timer is activated in step S331. Until the timer runout occurs in step S335, it is checked in step S333 whether or not the key cylinder 7 is in the unlocking position. Here, it is not detected that the key cylinder 7 is in the unlocking position. Thus the control returns to the main routine without performing anything else. Further, the control is switched or passed to the subroutine for operating the key cylinder or the subroutine for operating the transmitter. Moreover, this subroutine is performed.

AT Operation of Transmitter

Figure 9A:
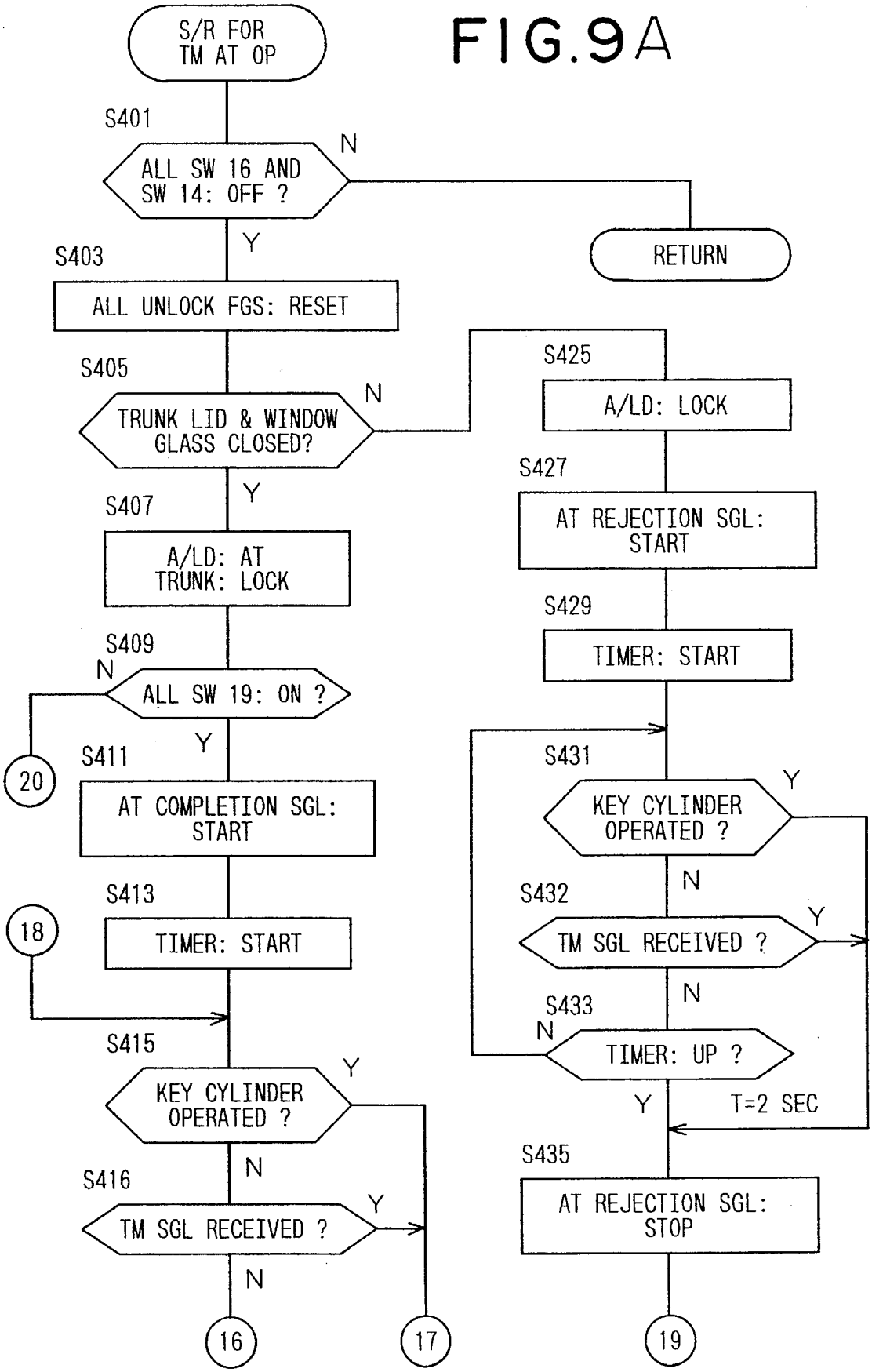
FIGS. 9A and 9B are flowcharts of a subroutine to be executed when performing an anti-theft operation on the transmitter.
Figure 9B:
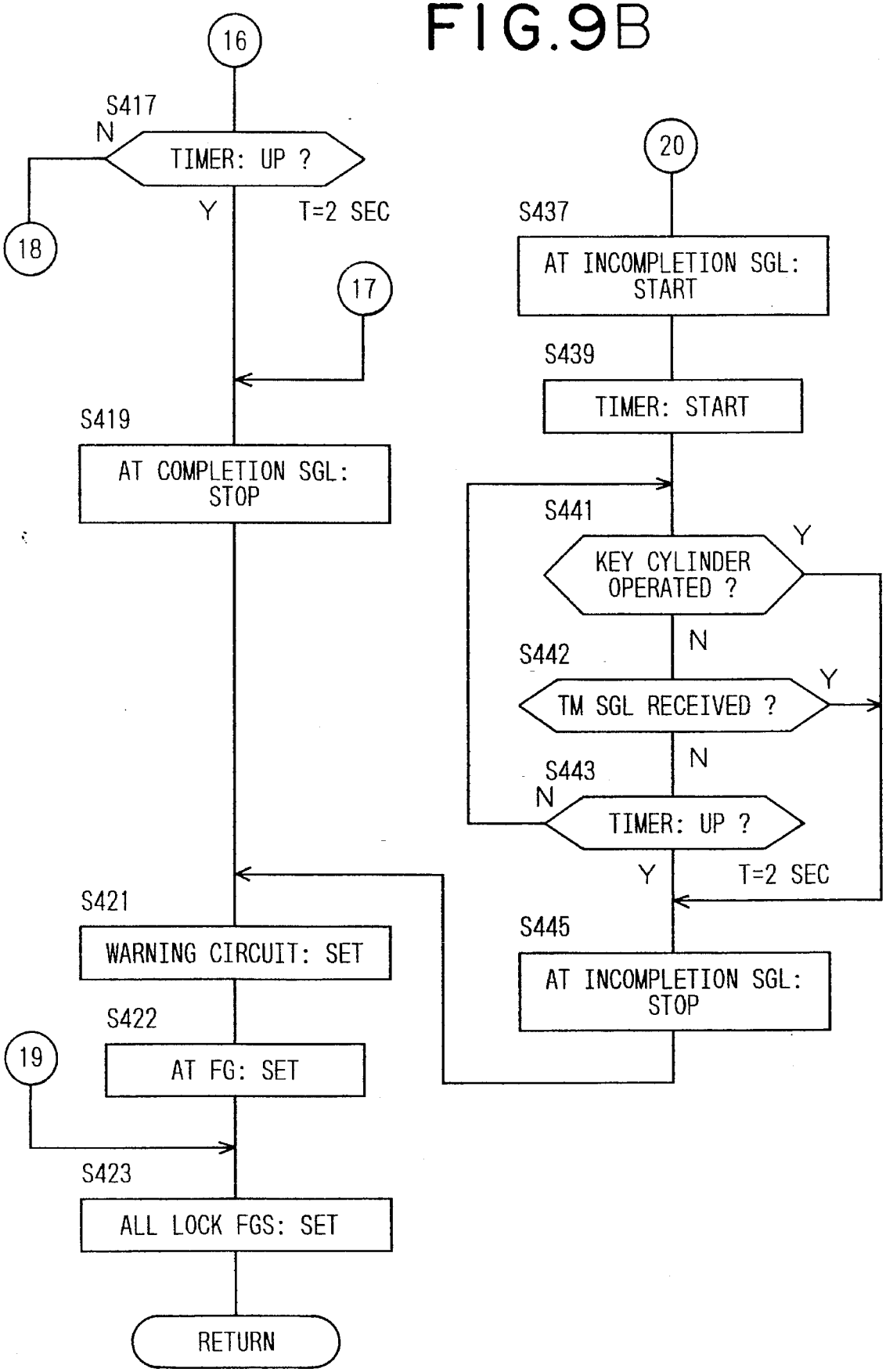

If an AT operation signal from the transmitter (TM) 22 is detected in step S013 of the main routine, the control is passed to a subroutine for performing an AT operation of the TM of FIGS. 9A and 9B.

When the control is passed to this subroutine, it is checked by means of the switches 16 and 14 in step S401 whether or not each door is opened or closed, and whether or not the ignition key is inserted. If the door is closed and the ignition key is not inserted, all of the unlock flags are reset in step S403. Subsequently, it is checked in step S405 whether or not a trunk and a window glass are closed. If both of the trunk and the window glass are closed, the positions of the lock levers 6 and 6' respectively corresponding to all of the doors are changed into the locking positions by use of the motor 11 and 11', respectively. Moreover, the positions of the AT mechanisms 10 and 10' are changed into the AT positions by means of the motors 11 and 11', respectively. Furthermore, the trunk is also locked in step S407. Next, it is verified for caution's sake in step S409 whether or not the positions of the AT mechanisms 10 and 10' of the locking apparatuses have actually been changed into the AT positions. Subsequently, the sending of the anti-theft completion signal is started in step S411. When the time period set by the timer has passed (steps S413 and S417), the sending of this signal is stopped in step S419. Then, the AT flag and all of the lock flags are set in steps S422 and S423 after the warning circuit 21 is set in step S421. Subsequently, the control is returned to the main routine.

However, if the operator operates the key cylinder (in step S415) or the transmitter (in step S416) during the timer operates, the sending of this signal is immediately stopped in step S419 even prior to the timer runout.

If it is verified in step S405 that the trunk or the window glass is open, only the locking is performed in step S425, but the states of the AT mechanisms are not changed into the AT states. Incidentally, because the change in states of the AT mechanisms into the AT states is not performed, the sending of the AT rejection signal is commenced in step S427. When the time period set by the timer has passed (steps S429 and S433), the sending of this signal is stopped in step S435. Then, the lock flags are set in step S423, and, the control is returned to the main routine.

However, if the operator operates the key cylinder (in step S431) or the transmitter (in step S432) during the timer operates, the sending of the AT rejection signal is immediately stopped in step S435 even prior to the timer runout. Thereafter, the lock flag is set in step S423, and the control is returned to the main routine. Further, the control is passed to the subroutine for operating the key cylinder or the transmitter and subsequently, this subroutine is executed.

If a faulty change in states of the AT mechanisms into the AT states occurs by any chance in step S409, the sending of the AT incompletion signal is started in step S437. When the time period set by the timer has passed (steps S439 and S443), the sending of this signal is stopped in step S445. Further, the warning circuit 21 is set in step S421. Subsequently, the AT flags and lock flags are set in steps S422 and S423. Then, the control returns to the main routine.

However, if it is detected in step S441 or S442 that the key cylinder or the transmitter is operated during the timer operates, the sending of the AT incompletion signal is immediately stopped in step S445. Thereafter, the warning circuit 21, the lock flags and the AT flags are set. Then, the control returns to the main routine. Further, the control is passed to the subroutine for operating the key cylinder or the transmitter and subsequently, this subroutine is executed.

Incidentally, in the case of this subroutine for performing an AT operation of the TM, the locking of the lock lever and the change in positions of the AT mechanisms into the AT positions are performed at a time. Therefore, only the AT completion signal is sent out as an operation confirmation signal.

Locking Operation of Transmitter

Figure 10A:
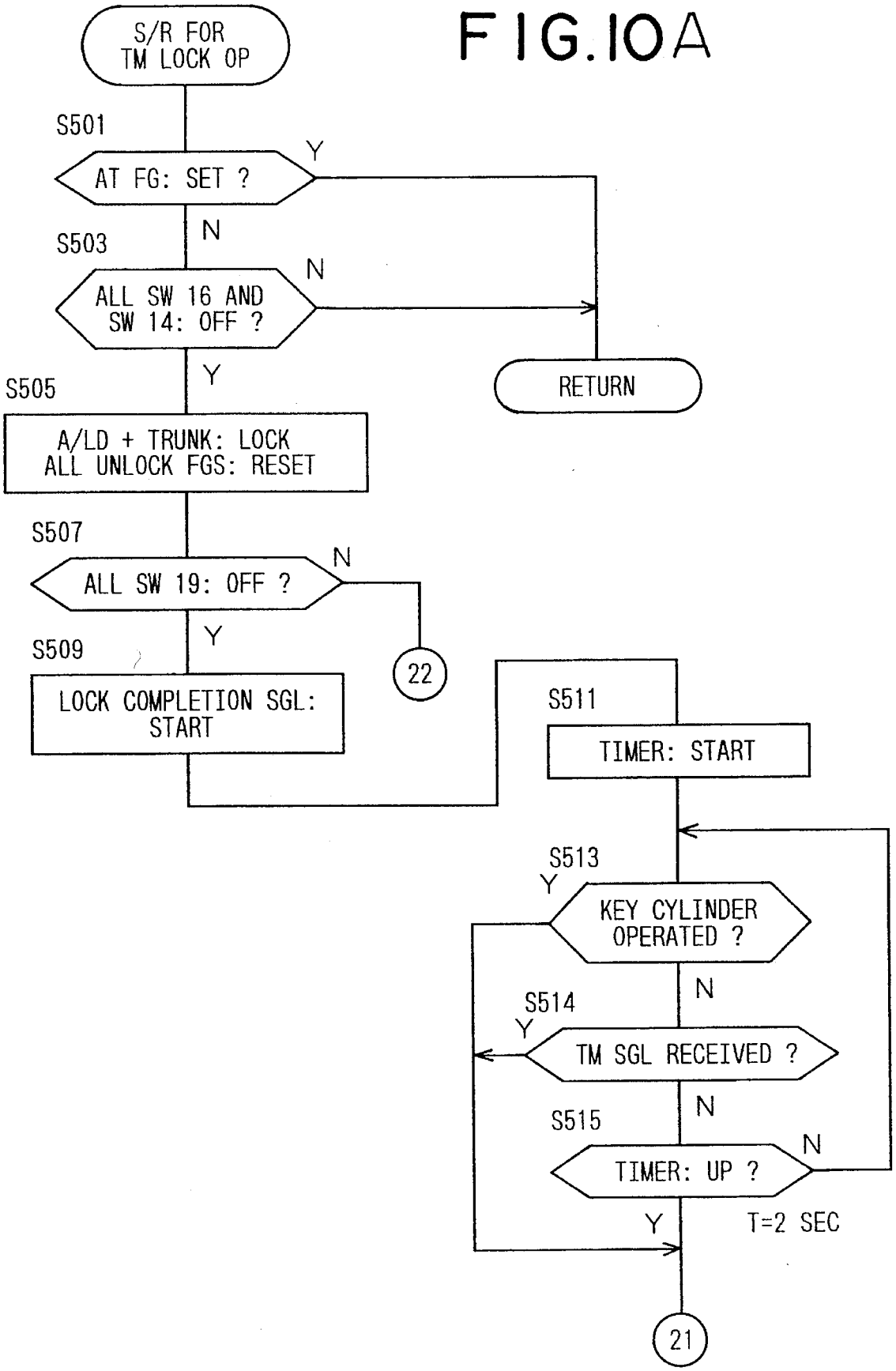
FIGS. 10A and 10B are flowcharts of a subroutine to be executed when locking the transmitter.
Figure 10B:
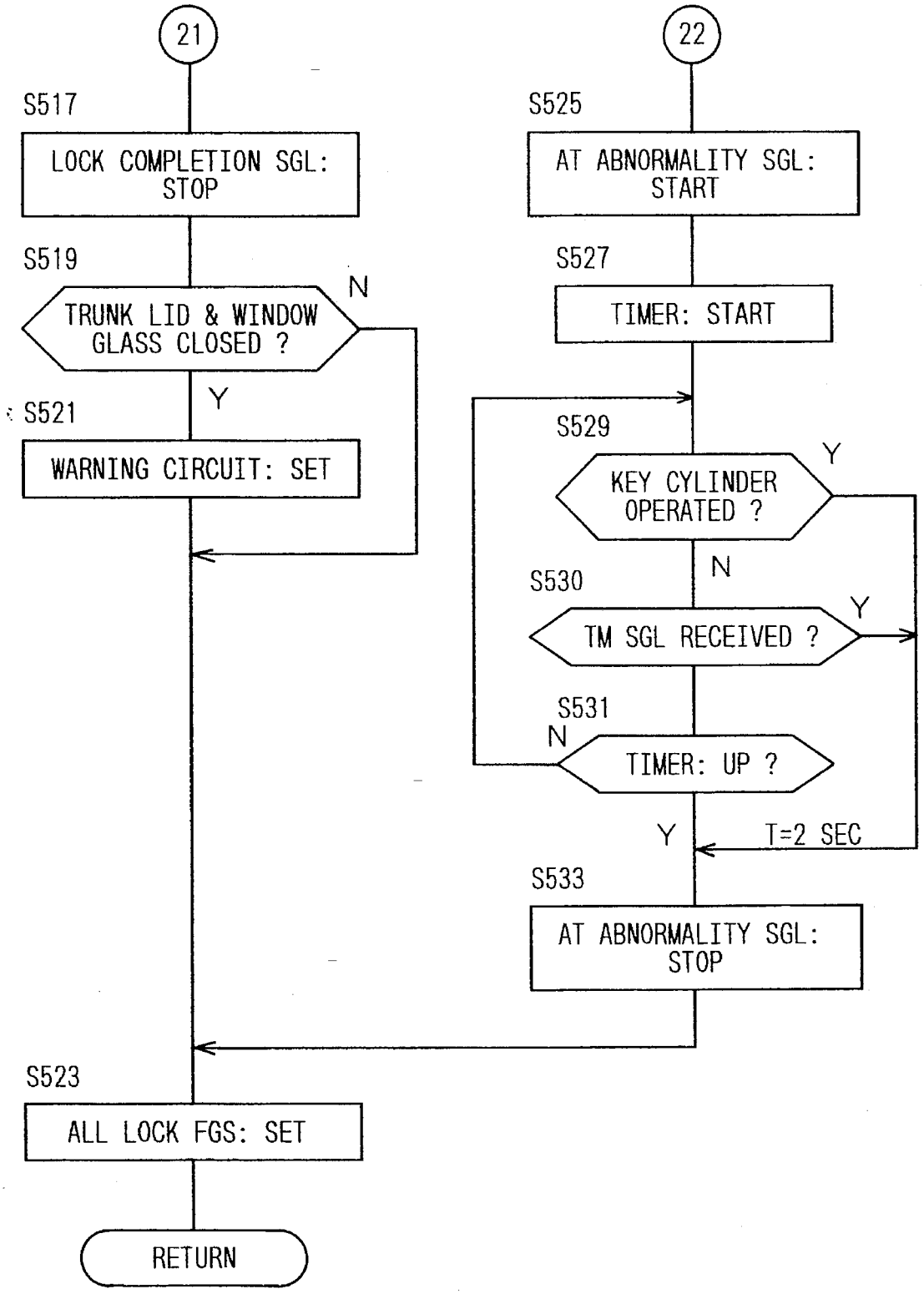

If the AT signal is detected in step S017 of the main routine, the control is passed to the subroutine for a TM locking operation illustrated in FIGS. 10A and 10B.

When the control is passed to this subroutine, the control portion 12 verifies in step S501 whether or not the AT flag is set. If the AT flag is set, it is unnecessary to lock the doors and the trunk again. Thus the control is returned to the main routine without performing anything else. If there is not the AT flag, it is checked in step S503 whether or not each door is opened or closed, and whether or not the ignition key is inserted. If the door is closed and the ignition key is not inserted, all of the doors and the trunk are locked and all of the unlock flags are reset in step S505. Subsequently, it is verified for caution's sake in step S507 whether or not the positions of the AT mechanisms 10 and 10' have been changed into the AT positions, respectively. If there are no AT mechanisms whose states are erroneously changed into the AT states, the sending of the lock completion signal is started in step S509. When the time period set by the timer has passed (steps S511 and S516), the sending of this signal is stopped in step S445. Next, it is checked in step S519 whether the window glass and the trunk are open or closed. If both of the window glass and the trunk are closed, the warning circuit 21 is set in step S521. Thereafter, all of the lock flags are set in step S523. Subsequently, the control is returned to the main routine.

However, if it is detected in step S513 or S514 that the key cylinder or the transmitter is operated during the timer operates, the sending of this signal is immediately stopped in step S517 even prior to the timer runout. Further, the control is passed to the subroutine for operating the key cylinder or the transmitter and subsequently, this subroutine is executed.

If one of the doors, whose position is erroneously changed into the AT position, is detected in step S507, the sending of the AT abnormality signal is started in step S525. When the time period set by the timer has passed (steps S527 and S531), the sending of this signal is stopped in step S533. Further, all of the lock flags are set in step S523. Then, the control is returned to the main routine.

However, if it is detected in step S529 or S530, during the timer operates, that the key cylinder or the transmitter is operated, the sending of this signal is immediately stopped in step S533. Thereafter, the lock flag is set in step S523, and the control is returned to the main routine.

Unlocking Operation of Transmitter

Figure 11:
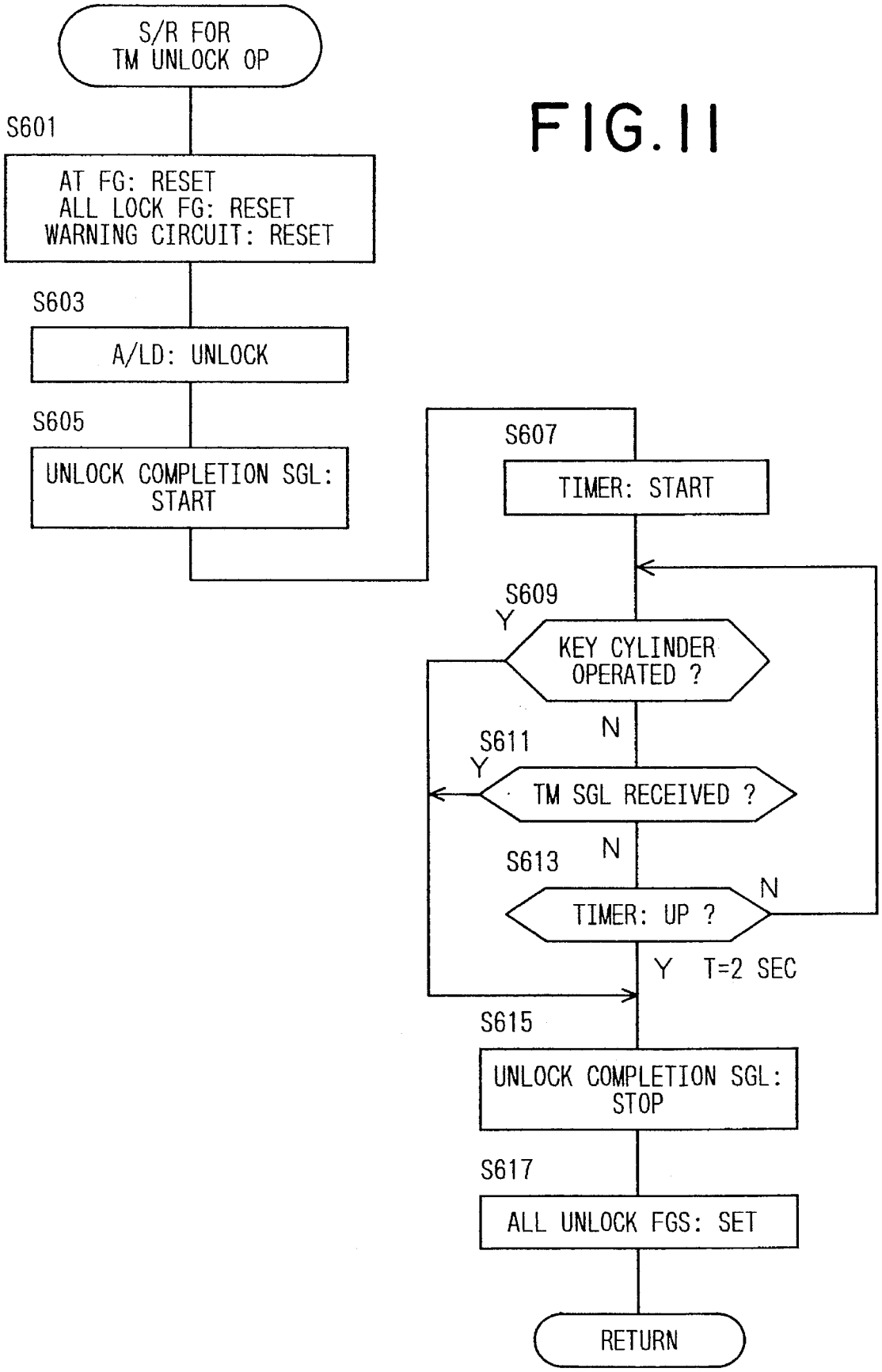
FIG. 11 is a flowchart of a subroutine to be executed when unlocking the transmitter.
Figure 12:
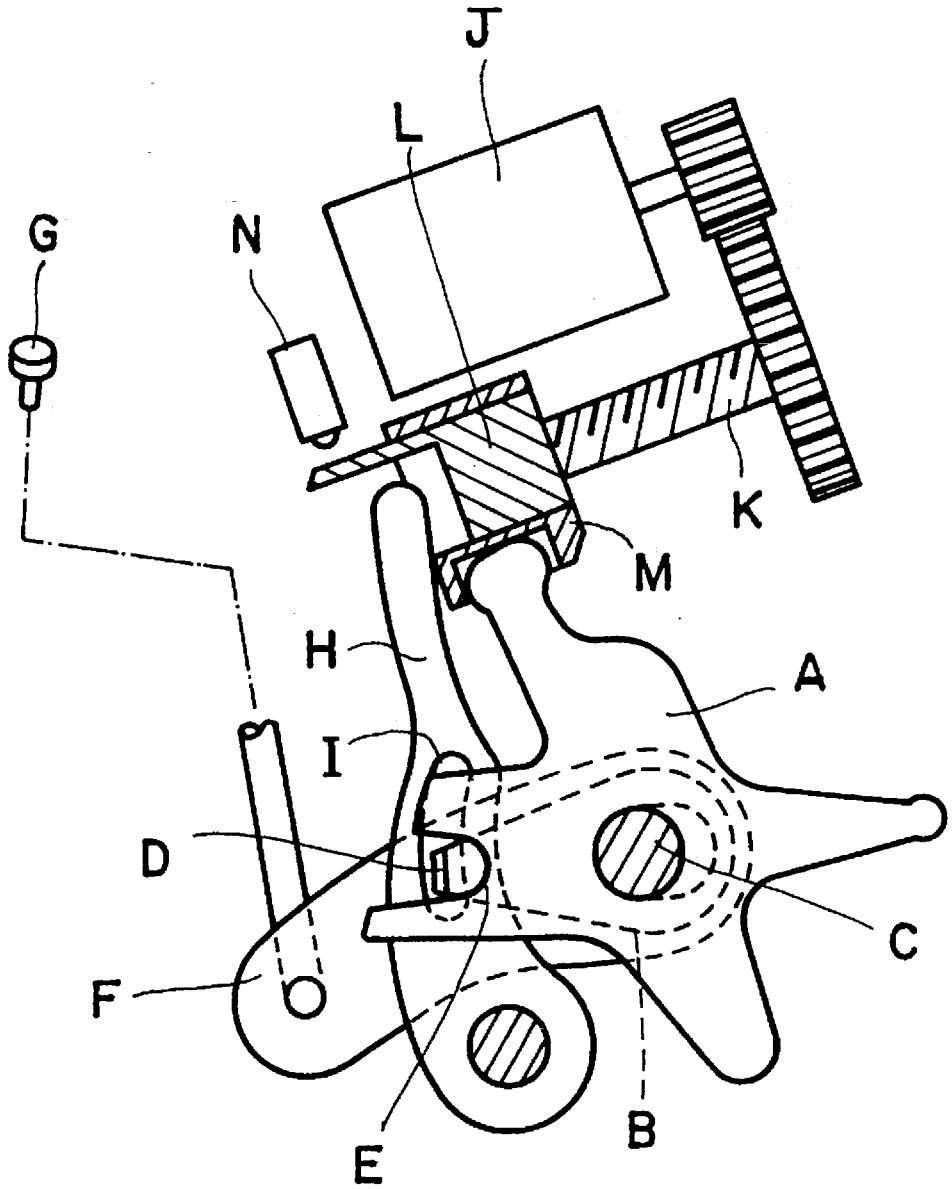
FIG. 12 (PRIOR ART)
FIG. 12 is a diagram for illustrating the conventional door locking apparatus.

If the unlocking signal of the transmitter 22 is detected in step S021 of the main routine, the control is passed to the subroutine for a TM unlocking operation illustrated in FIG. 11.

When the control is passed to this subroutine, the AT flag and all of the lock flags are reset and the warning circuit 21 is reset in step S601 as a preprocessing. Subsequently, all of the doors are unlocked in step S603. Then, the sending of the unlock completion signal is started in step S605. When the time period set by the timer has passed (steps S607 and S613), the sending of this signal is stopped in step S615. Next, all of the unlock flags are set in step S617. Subsequently, the control is returned to the main routine.

However, if it is detected in step S609 or S611 that the key cylinder or the transmitter is operated during the timer operates, the sending of this signal is immediately stopped in step S615. Then, the control is passed to the subroutine for operating the key cylinder or the transmitter and subsequently, this subroutine is executed.

Incidentally, the detailed illustrations and descriptions of the remaining subroutines described in FIG. 6B are omitted herein.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A method of controlling a first locking apparatus for a driver's door and a second locking apparatus for each remaining door comprising the steps of:

changing a state of each said second locking apparatus into a locked state when a locking operation is performed on a key cylinder of the driver's door;

changing a state of each said second locking apparatus into an unlocked state when an unlocking operation is performed on the key cylinder;

changing a state of each of all of the locking apparatuses into an anti-theft state when an anti-theft operation is performed on the key cylinder; and changing a state of each of all of the locking apparatuses into an anti-theft canceling state when an anti-theft canceling operation is performed on the key cylinder, wherein when the locking operation is performed on the key cylinder, it is checked as to whether or not each of all of the locking apparatuses are respectively in the anti-theft state, and further, an operation of sending out a warning signal is performed for a predetermined time period if it is detected that one of the locking apparatuses is in the anti-theft state.

2. The method according to claim 1, wherein if the key cylinder is operated during the predetermined time the warning signal is sent out, the operation of sending out the warning signal is stopped even before the predetermined time period has elapsed.

3. A method of controlling a first locking apparatus for a driver's door and a second locking apparatus for each remaining door comprising the steps of:

changing a state of each said second locking apparatus into a locked state when a locking operation is performed on a key cylinder of the driver's door;

changing a state of each said second locking apparatus into an unlocked state when an unlocking operation is performed on the key cylinder;

changing a state of each of all of the locking apparatuses into an anti-theft state when an anti-theft operation is performed on the key cylinder; and changing a state of each of all of the locking apparatuses into an anti-theft canceling state when an anti-theft canceling operation is performed on the key cylinder, wherein when the anti-theft operation is performed on the key cylinder, it is checked as to whether or not each of all of the locking apparatuses are respectively in the anti-theft state, and wherein an operation of sending out a warning signal is performed for a predetermined time period if it is detected that one of the locking apparatuses is in the anti-theft canceling state.

4. The method according to claim 3, wherein if the key cylinder is operated during the predetermined time the warning signal is sent out, the operation of sending out the warning signal is stopped even before the predetermined time period has elapsed.

5. A method of controlling vehicle door locking apparatuses comprising the steps of:

changing a state of each of all of the locking apparatuses into a locked state, respectively, when a locking operation is performed on a transmitter;

changing a state of each of all of the locking apparatuses into an unlocked. state, respectively, when an unlocking operation is performed on the transmitter;

changing a state of each of all of the locking apparatuses into an anti-theft state, respectively, when an anti-theft operation is performed on the transmitter; and changing a state of each of all of the locking apparatuses into an anti-theft canceling state, respectively, when an anti-theft canceling operation is performed on the transmitter, wherein when the locking operation is performed on the transmitter, it is checked whether or not all of the locking apparatuses are respectively in the anti-theft states, and further, an operation of sending out a warning signal is performed for a predetermined time period if it is detected that one of the locking apparatuses is in the anti-theft state.

6. The method according to claim 5, wherein if the transmitter is operated during the predetermined time the warning signal is sent out, the operation of sending out the warning-signal is stopped even before the predetermined time period has elapsed.

7. A method of controlling vehicle door locking apparatuses comprising the steps of:

changing a state of each of all of the locking apparatuses into a locked state, respectively, when a locking operation is performed on a transmitter;

changing a state of each of all of the locking apparatuses into an unlocked state, respectively, when an unlocking operation is performed on the transmitter;

changing a state of each of all of the locking apparatuses into an anti-theft state, respectively, when an anti-theft operation is performed on the transmitter; and changing a state of all of the locking apparatuses into anti-theft canceling state, respectively, when an anti-theft canceling operation is performed on the transmitter, wherein when the anti-theft operation is performed on the transmitter, it is checked whether or not all of the locking apparatuses are respectively in the anti-theft states, and wherein an operation of sending out a warning signal is performed for a predetermined time period if it is detected that one of the locking apparatuses is in the anti-theft canceling state.

8. The method according to claim 7, wherein if the transmitter is operated during the predetermined time the warning signal is sent out, the operation of sending out the warning signal is stopped even before the predetermined time period has elapsed.

9. A vehicle door locking system comprising: a first locking apparatus having a first latch mechanism engaged with a first striker fixed to a vehicle body so as to maintain a closed state of a driver's door, a first opening lever connected to a door opening handle of the driver's door and when turned, adapted to cancel engagement between the latch mechanism and the striker to thereby open the driver's door, and a first lock lever connected to a key cylinder and an inside locking button of the driver's door and adapted to change a position thereof between a locking position for disabling the opening lever from opening the driver's door and an unlocking position for enabling the opening lever to open the driver's door;

a second locking apparatus having a second latch mechanism engaged with a second striker fixed to the vehicle body so as to maintain a closed state of an additional door, a second opening lever connected to a door opening handle of the additional door and wherein turned, adapted to cancel engagement between the second latch mechanism and the second striker to thereby open the additional door, a second lock lever connected to an inside locking button of the additional door and adapted to change a position thereof between a locking position for disabling the second opening lever from opening the additional door and an unlocking position for enabling the second opening lever to open the additional door, and a motor for changing the position of the second lock lever; a control portion for activating the motor when the position of the first lock lever is changed into the locking position or the unlocking position, to thereby change the position of the second lock lever into a position corresponding to the position of the first lock lever; and signal means for sending out a signal in response to an action of the control portion, wherein the control portion contains a first subroutine for performing a control operation of causing the motor, when the key cylinder is locked, to carry out a locking rotation to thereby change the position of the second lock lever into the locking position and for performing another control operation of causing the signal means, when a faulty change in position of the second lock lever occurs, to send out a warning signal.

10. The vehicle door locking system according to claim 9, wherein when the position of the key cylinder is changed during sending out the signal, the first subroutine is executed so as to further perform another control operation of causing the signal means to immediately stop sending out the signal.

11. A vehicle door locking system comprising:

a first locking apparatus having a first latch mechanism engaged with a first striker fixed to a vehicle body so as to maintain a closed state of a driver's door, a first opening lever connected to a door opening handle of the driver's door and when turned adapted to cancel engagement between the latch mechanism and the striker to thereby open the driver's door, a first lock lever connected to a key cylinder and an inside locking button of the driver's door and adapted to change a position thereof between a locking position for disabling the opening lever from opening the driver's door and an unlocking position for enabling the opening lever to open the driver's door, a first anti-theft mechanism whose position is changed between an anti-theft position for disconnecting the inside locking button from the first lock lever and a canceling position for connecting the inside locking button with the first lock lever, and a first motor for changing the position of the first anti-theft mechanism;

a second locking apparatus having a second latch mechanism engaged with a second striker fixed to the vehicle body so as to maintain a closed state of an additional door, a second opening lever connected to a door opening handle of the additional door and when turned adapted to cancel engagement between the second latch mechanism and the second striker to thereby open the additional door, a second lock lever connected to an inside locking button of the additional door and adapted to change a position thereof between a locking position for disabling the second opening lever from opening the additional door and an unlocking position for enabling the second opening lever to open the additional door, a locking motor for changing the position of the second lock lever, a second anti-theft mechanism whose position is changed between an anti-theft position for disconnecting the inside locking button of the additional door from the second lock lever and a canceling position for connecting the inside locking button of the additional door with the second lock lever, and a second motor for changing the position of the second anti-theft mechanism;

a control portion for controlling the first motor, the second motor and the locking motor; and signal means for sending out a signal in response to an action of the control portion, wherein the control portion contains a first subroutine for performing a control operation of causing the first motor and the second motor, when an anti-theft operation is performed on the key cylinder, to carry out anti-theft rotations to thereby change the positions of the first anti-theft mechanism and the second anti-theft mechanism into anti-theft positions and for performing another control operation of causing the signal means, when a faulty change in position of the first anti-theft mechanism or the second anti-theft mechanism occurs, to send out a warning signal.

12. The vehicle door locking system according to claim 11, wherein when the position of the key cylinder is changed during sending out the signal, the first subroutine is executed so as to further perform another control operation of causing the signal means to immediately stop sending out the signal.

* * * * *